US010118727B2

(12) United States Patent
Wilcox et al.

(10) Patent No.: US 10,118,727 B2
(45) Date of Patent: Nov. 6, 2018

(54) CONTAINER HAVING AN ACCESS DOOR LATCHING SYSTEM

(71) Applicant: Arena Packaging, LLC, Rochester, NY (US)

(72) Inventors: Donald E. Wilcox, Rochester, NY (US); Charles S. Arena, Rochester, NY (US)

( * ) Notice: Subject to any disclaimer, the term of this patent is extended or adjusted under 35 U.S.C. 154(b) by 125 days.

(21) Appl. No.: 15/266,652

(22) Filed: Sep. 15, 2016

(65) Prior Publication Data

US 2018/0072454 A1 Mar. 15, 2018

(51) Int. Cl.

| | |
|---|---|
| ***B65D 21/032*** | (2006.01) |
| ***B65D 6/18*** | (2006.01) |
| ***B65D 21/02*** | (2006.01) |
| ***B65D 21/08*** | (2006.01) |
| ***B65D 85/34*** | (2006.01) |

(52) U.S. Cl.

CPC ..... *B65D 11/1833* (2013.01); *B65D 21/0209* (2013.01); *B65D 21/086* (2013.01); *B65D 85/34* (2013.01)

(58) Field of Classification Search

CPC .. B65D 85/34; B65D 21/086; B65D 21/0209; B65D 11/1833; B65D 11/184

See application file for complete search history.

(56) References Cited

U.S. PATENT DOCUMENTS

| | | | |
|---|---|---|---|
| 3,544,146 | A | 12/1970 | Asenbauer |
| 3,797,870 | A | 3/1974 | Beckman |
| 3,878,980 | A | 4/1975 | Crane |
| 3,888,525 | A | 6/1975 | Kousens |
| 3,935,990 | A | 2/1976 | Crane |
| 3,935,991 | A | 2/1976 | Crane |
| 4,192,430 | A | 3/1980 | Cornou |
| 4,284,299 | A | 8/1981 | Kelly |
| 4,492,396 | A | 1/1985 | Luke et al. |
| 4,817,799 | A | 4/1989 | Gregerson et al. |
| 4,917,255 | A | 4/1990 | Foy et al. |
| 4,917,413 | A | 4/1990 | Jason et al. |
| 4,967,927 | A | 11/1990 | Reiland et al. |
| 5,100,015 | A | 3/1992 | Vanderstuyf |
| 5,121,952 | A | 6/1992 | Jason |
| 5,147,061 | A | 9/1992 | Karpisek |

(Continued)

FOREIGN PATENT DOCUMENTS

| | | | |
|---|---|---|---|
| CN | 203877100 | U | 10/2014 |
| DE | 102006005873 | A1 | 8/2007 |

(Continued)

OTHER PUBLICATIONS

Co-pending U.S. Appl. No. 62/387,285, filed Dec. 23, 2015.

*Primary Examiner* — Stephen Castellano
(74) *Attorney, Agent, or Firm* — Bond, Schoeneck & King, PLLC; Jeffrey Powers

(57) ABSTRACT

A container having an interior, comprising a base and four walls. One of the walls having an opening allowing access to the interior. The one of the walls having an at least one catch along a lateral side disposed a wall intermediate location. A door having a rigid upper portion and a rigid lower portion coupled together by a first hinge at a door intermediate location which is positioned at or above the wall intermediate location. The door having at least one rigid latch extending from the upper portion to a location below the door intermediate location when the door is in an unflexed state.

10 Claims, 22 Drawing Sheets

(56) References Cited

U.S. PATENT DOCUMENTS

| | | | |
|---|---|---|---|
| 5,161,709 | A | 11/1992 | Oestreich, Jr. |
| 5,199,592 | A | 4/1993 | Reiland et al. |
| 5,275,302 | A | 1/1994 | Uitz |
| 5,289,933 | A | 3/1994 | Streich et al. |
| 5,474,197 | A | 12/1995 | Hillis et al. |
| 5,501,356 | A | 3/1996 | Billingham |
| 5,583,612 | A | 12/1996 | Schell et al. |
| 5,617,711 | A | 4/1997 | Rodriguez et al. |
| 5,727,711 | A | 3/1998 | Emond et al. |
| 5,755,350 | A | 5/1998 | Marthaler |
| 6,203,077 | B1 | 3/2001 | Schlack |
| 6,220,637 | B1 | 4/2001 | Kierl |
| 6,283,319 | B1 | 9/2001 | Hillis et al. |
| 6,290,081 | B1 | 9/2001 | Merey |
| 6,293,418 | B1 | 9/2001 | Ogden et al. |
| 6,373,690 | B1 | 4/2002 | Buican et al. |
| 6,484,898 | B2 | 11/2002 | Hillis et al. |
| 6,595,605 | B1 | 7/2003 | Babcock et al. |
| 6,712,404 | B2 | 3/2004 | Davies et al. |
| 6,776,300 | B2 | 8/2004 | Walsh et al. |
| 6,834,766 | B2 | 12/2004 | Lin et al. |
| 6,868,979 | B2 | 3/2005 | Rader |
| 6,918,508 | B2 | 7/2005 | Hwang |
| 6,921,227 | B1 | 7/2005 | De Jong et al. |
| 7,063,223 | B2 | 6/2006 | Iwahara et al. |
| 7,198,149 | B2 | 4/2007 | Gelardi |
| 7,264,122 | B2 | 9/2007 | Koefelda et al. |
| 7,273,203 | B2 | 9/2007 | Carnevali |
| 7,416,092 | B2 | 8/2008 | Dubois et al. |
| 7,484,634 | B2 | 2/2009 | Apps |
| 7,617,947 | B2 | 11/2009 | Schafer |
| 7,828,167 | B2 | 11/2010 | Nolan |
| 7,896,184 | B2 | 3/2011 | Meers |
| 7,963,494 | B2 | 6/2011 | Hsiung et al. |
| 8,052,000 | B2 | 11/2011 | Apps |
| 8,066,147 | B2 | 11/2011 | Meers et al. |
| 8,109,402 | B2 | 2/2012 | Hartwall |
| 8,413,831 | B2 | 4/2013 | Nolan |
| 8,469,224 | B2 | 6/2013 | Orgeldinger |
| 8,631,956 | B2 | 1/2014 | Dowd |
| 8,640,912 | B2 | 2/2014 | Orgeldinger |
| 8,651,310 | B2 | 2/2014 | Orgeldinger |
| 8,662,333 | B2 | 3/2014 | Orgeldinger |
| 8,727,158 | B2 | 5/2014 | Nolan |
| 8,727,165 | B2 | 5/2014 | Nolan |
| 8,757,412 | B2 | 6/2014 | Sommer et al. |
| 8,807,365 | B2 | 8/2014 | Orgeldinger |
| 8,820,560 | B2 | 9/2014 | Nolan |
| 8,875,924 | B2 | 11/2014 | Orgeldinger |
| 8,915,397 | B2 | 12/2014 | Petersen et al. |
| 8,950,613 | B2 | 2/2015 | Nolan |
| 9,278,775 | B2 | 3/2016 | Meers et al. |
| 9,296,557 | B2 | 3/2016 | Petersen et al. |
| 9,403,621 | B2 | 8/2016 | Dubois et al. |
| 9,415,898 | B2 | 8/2016 | Nolan |
| 9,422,082 | B2 | 8/2016 | Nolan et al. |
| 2007/0084864 | A1 | 4/2007 | Thrush et al. |
| 2007/0278223 | A1 | 12/2007 | Ficker |
| 2008/0264938 | A1 | 10/2008 | Tibbels et al. |
| 2009/0101640 | A1 | 4/2009 | Hadar |
| 2010/0072198 | A1 | 5/2010 | Roemer et al. |
| 2011/0139775 | A1 | 6/2011 | Nolan |
| 2011/0240657 | A1 | 10/2011 | Orgeldinger |
| 2013/0193153 | A1 | 8/2013 | Baltz et al. |
| 2014/0252018 | A1 | 9/2014 | Nolan |
| 2016/0039598 | A1 | 2/2016 | Wilcox et al. |

FOREIGN PATENT DOCUMENTS

| | | | |
|---|---|---|---|
| EP | 2371740 | A1 | 10/2011 |
| WO | 8607406 | | 12/1986 |
| WO | 9824151 | | 6/1998 |
| WO | 03/043911 | A1 | 5/2003 |
| WO | WO2014176292 | A1 | 10/2014 |
| WO | WO2015134067 | A1 | 9/2015 |

CONTAINER HAVING AN ACCESS DOOR LATCHING SYSTEM

FIELD

Containers, especially containers having an access door for accessing an interior of the container.

BACKGROUND

Bananas are harvested from trees in tropical growing regions such as Central and South America. Bananas to be exported are picked green, shipped to distribution centers in consuming regions, and delivered to retail stores in a state of ripeness appropriate for retail sale. Conventionally, growers pack bananas in covered, corrugated cardboard boxes containing about 40 pounds of bananas per box.

The industry-standard method for packaging bananas for shipment to North American retailers has been to pack in corrugated cardboard boxes that have been tailored to this application. Corrugated boxes for bananas are of a 2-piece construction with outside dimensions of about 19.7" (50 cm) in length×15.75" (40 cm) in width×9.69" (24.6 cm) in height. The 2-piece boxes include a bottom and a top cover that telescopes the full height of the bottom to contribute to stacking strength due to the resultant double-wall construction. Corrugated boxes weigh approximately 3 lbs. each.

Filled boxes are placed on pallets in eight layers, each layer including 5 or 6 boxes. Bananas are refrigerated to between 13.5° and 15° C. (56.3 and 59.0° F.) during transport to suspend the ripening process ("put the bananas to sleep"). This allows bananas to reach grocery stores without being overripe.

Pallets of cooled ("sleeping") bananas are loaded onto ships for transport from growing regions to consuming regions. Temperature continues to be controlled throughout shipment to distribution centers in the consuming regions. Acceptance testing usually occurs at a distribution center. Upon arrival, bananas on a given pallet are inspected to determine if the shipment will be accepted or rejected. A typical inspection involves sampling bananas in 3-4 boxes on each pallet. The bananas are selected at different layers and sides of the 30-48 box arrangement to determine the quality of bananas and their state of ripeness. When shipping in corrugated boxes, a hole is cut in the selected boxes with a knife. One or more bananas are removed through the hole and inspected. Attributes tested include physical appearance, size, sweetness, and temperature.

Accepted pallets of bananas are moved to a ripening room. There the temperature of the bananas is raised and the bananas are exposed to ethylene gas to restart the ripening process ("waken the bananas"). The ripening process continues in the ripening room for about 3-5 days. After sufficient ripening, the pallets are loaded onto trucks at the distribution center for delivery to retail stores. Bananas are inspected during the ripening process in a manner similar to inspection during acceptance so that ripening conditions can be adjusted if needed.

The current transport process for bananas has several disadvantages. During the inspection process, the cutting of containers may result in direct damage to the bananas from the cutting implement as a container is cut, and indirect damage to the bananas may result from structural weakness caused by the cutting of the boxes, which may result in the crushing of bananas during transportation.

Plastic containers have been produced that are designed to replace cardboard boxes for shipping bananas, although they have achieved only limited commercial success. Plastic containers have included re-closable access doors with a hinge at a bottom end and a latch at the top end; however, they have been relatively heavy and had stiff construction. Stiff RPCs with 4 walls and a base are designed to handle stacking loads transferred through the walls and base of containers to the pallet with a safety margin to achieve many years of life. The stiff nature of the RPC has exacerbated packing damage associated with transporting the requisite quantity of bananas.

One proposed plastic container, described in published PCT Application WO2015134067, has a light weight construction giving the box a relatively high flexibility that is similar to corrugated cardboard boxes.

To achieve the reduced weight, the thicknesses of walls have been reduced, and rigidizing features such as ribs in the walls have been reduced in number and in thickness, and positioned to result in increased flexibility of the walls.

While such design choices address concerns such as container weight and damage to fruit, they present challenges in maintaining sufficient integrity of the erected boxes.

BRIEF SUMMARY OF THE INVENTION

In a flexible plastic container, one particular challenge occurs as a result of the access door flexing excessively due to the internal pressure from the fruit (e.g., bananas), which results in the edges of the door separating (in an outward direction) from the wall from which it is to contact. The separation results in catch points which, when the containers are stacked and de-stacked, and as the pallets full of containers are moved relative to one another in a warehouse or shipping vessel, results in pallets and containers contacting the catch points and damaging the door and/or at least partially tearing the door from the container. Use of conventional latches proximate the middle of the lateral edges of the access door of a thinned, flexible container was found unworkable due to the limited space available for the latch; such latches extended excessively into the interior of the container where contents may be damaged, or extending from the exterior of the container resulting in catch points.

An aspect of the invention is directed to a container having an interior to hold produce, comprising a base and four walls. The four walls, in combination with the base, define the interior. Each of the walls is coupled to the base. At least one of the walls has an opening allowing access to the interior. The one of the walls has an at least one catch positioned at a wall intermediate location along a lateral side of the opening. A door having a rigid upper portion and a rigid lower portion. The lower portion is coupled to the upper portion by a first hinge at a door intermediate location. The door intermediate location is positioned at or above the wall intermediate location when the container is in an erected arrangement. The upper portion has an upper end and the lower portion having a lower end. The door is coupled to the one of the walls by a hinge at the lower end. The door is movable about the hinge from a closed position in which the door covers the opening to an open position in which the interior can be accessed through the opening. The door has at least one rigid latch extending from the upper portion to a location below the door intermediate location when the door is in an unflexed state and the at least one rigid latch is aligned with the at least one catch so as to be received in a space defined by the catch. An interior surface of the catch faces an exterior-facing surface of the latch when the door is moved to the closed position. The door has a connector to connect the upper end to the one of the walls to maintain the closed position. The hinge may be a living hinge.

In some embodiments, the container further comprises a second catch along a second lateral side of the opening that is opposite the lateral side on which the first latch is disposed. The second rigid latch extends from the upper portion to a location below the door intermediate location when the door is in an unflexed state and the second latch is aligned with the second catch so as to be received in a second space defined by the second catch. An interior surface of the second catch faces an exterior-facing surface of the second latch when the door is moved to the closed position. In some embodiments, the door intermediate location is disposed at a midpoint of the door.

In some embodiments, the four walls comprise two opposing sidewalls and two opposing endwalls. In such embodiments, the opening may be disposed in a sidewall.

In some embodiments, each of the walls is attached to the base by a corresponding at least one rotatable bearing. In some embodiments, the at least one of the walls comprises a jam extending around at least a portion of the opening, and the door rests against the jam when the door is in a closed position.

In some embodiments, the interior-facing surface is disposed on an outer wall of the catch the outer wall defining a space into which the latch is received, and the catch further comprises at least one of a side wall and an inner wall to further define the space.

In some embodiments, the interior surface of the catch has a convex shape and the exterior-facing surface of the latch has a concave shape, the exterior-facing surface of the latch being interfaced with the interior surface of the catch.

The term "rigid" as used herein refers to an object that is able to support itself against gravity in all orientations. It will be appreciated that a rigid object may some flexibility. A portion of an object that cannot support itself against gravity (e.g., a hinge) is not rigid.

The term "latch" is defined herein to mean a protrusion.

The term "catch" is defined herein to mean a mechanical feature including at least one protrusion defining, at least in part, a space into which a latch is received, and after receipt of the latch into the space, the at least one protrusion limiting the movement of the latch in at least one direction.

The term "protrusion" is defined herein to mean a feature that projects outward from its immediate surrounding.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1A:
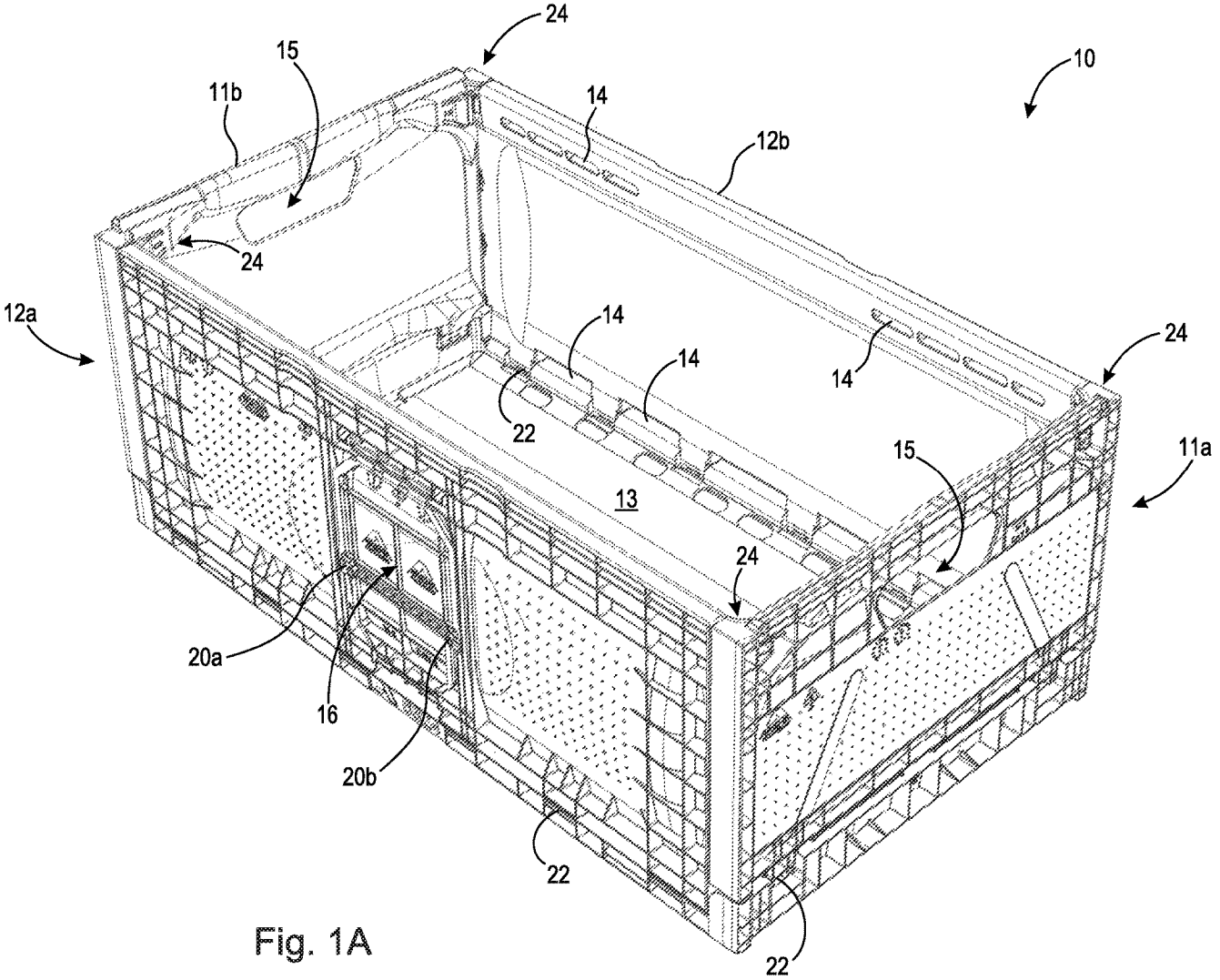
FIGS. 1A and 1B illustrate an example of an embodiment of a container according to aspects of the present invention in an erected configuration and a collapsed configuration, respectively.
Figure 1B:
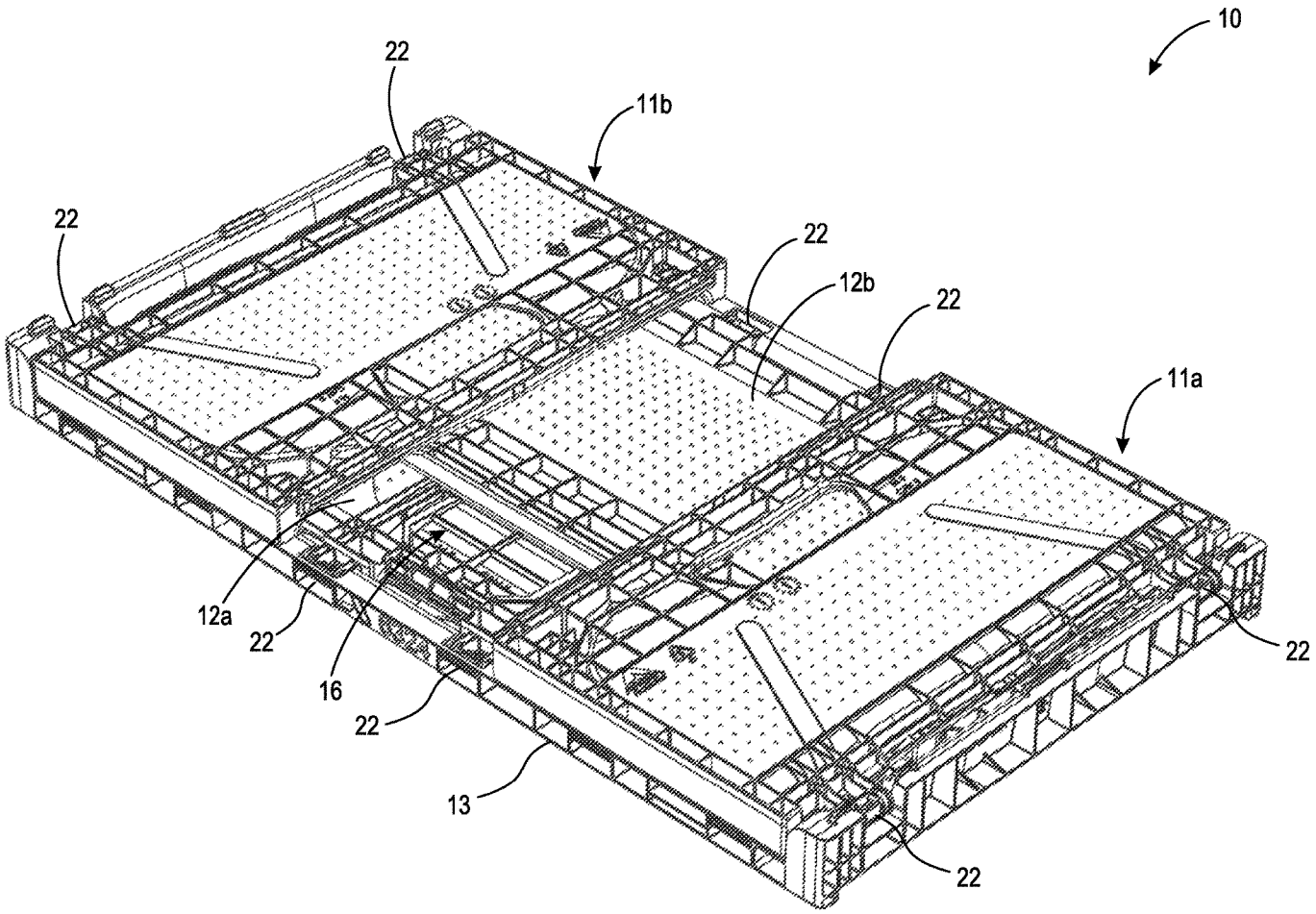

An example of an embodiment of a container according to aspects of the present invention is depicted in FIGS. 1A and 1B as a collapsible container 10 having an interior for the storage and transport of produce. FIGS. 1A and 1B illustrated the container in an erected configuration and a collapsed configuration, respectively. Container 10 includes a base 13 that extends in a horizontal plane, and four walls (illustrated as two endwalls 11*a*, 11*b*, and two sidewalls 12*a*, 12*b*). At least one of the walls 12*a* includes an opening O (shown in FIG. 2A) through which access to the interior of the container is allowed. An access door 16 covers the opening when in a closed position. As described in greater detail below, wall 12*a* and the access door 16 together include a latching system to secure the access door to wall 12*a* and eliminate or decrease the likelihood of formation of catch points at the access door.

A latching system may be provided with a latching sub-system in accordance with aspects of the invention on both lateral sides of the door (i.e., latching sub-system 20*a* and latching sub-system 20*b*) or can be provided with a latching sub-system in accordance with aspects of the invention on only one lateral side. Each latching sub-system comprises a latch and a catch. In the discussion below, only one latching sub-system is illustrated and described in detail, however, it will be understood that a second latching sub-system may be provided. The second latching system is typically configured and operated in a same manner as the first latching system. Typically, the second latching sub-systems is a mirror image of the first latching system, however, it is to be understood that the sub-systems may any suitable construction, for example a construction as described herein.

The interior of the container 10 is primarily defined by the base 13, sidewalls 12 and endwalls 11. A handle 15 is located near the top center of each endwall 11. The base 13 and endwalls 11, sidewalls 12 interior surfaces may be flat and smooth, or contoured to reduce the likelihood of bruising the contents of the container. Because the container is designed to hold produce that may be purposely ripened while in the interior of the container, the container may have various ventilation holes 14 along its walls 12*a*, 12*b* and base 13, which allow for forced air to travel to the produce while packed in the container.

The endwalls 11 and sidewalls 12 of the container may be connected to the base 13 through the use of a plurality of hinges 22 (as shown) or other movable couplings, or may be rigidly connected to the base 13. Hinges 22 permit the endwalls 11 and sidewalls 12 to be folded down toward the base 13 when the container is in the "collapsed" arrangement (shown in FIG. 1B), and the hinges 22 allow the endwalls 11 and sidewalls 12 to be moved to an upright position when the container is in the "erected" arrangement (shown in FIG. 1A). In embodiments including hinged walls, conventional corner latching systems 24 may be used to maintain the walls in the erected arrangement.

Container 10 is typically molded from a plastic material, for example polypropylene. Suitable plastic materials include, but are not limited to, polyethylene, polypropylene, polyvinyl chloride, polyurethane, polyester, epoxy resin, phenolic resin, polystyrene, polycarbonate, combinations thereof and the like. The term "plastic" is used generically herein in its conventional manner and refers to any of the above-listed materials or other similar materials now existing or later developed. Container 10 has a construction that is designed to be strong relative to its weight. The material of the container allows it to be rigid enough to maintain its structural form when erected for storage or transportation, thereby protecting the produce it contains. At the same time, the material of the base 13, endwalls 11, and sidewalls 12 of the container 10 are flexible enough to minimize damage to the contents of the container.

Figure 2A:
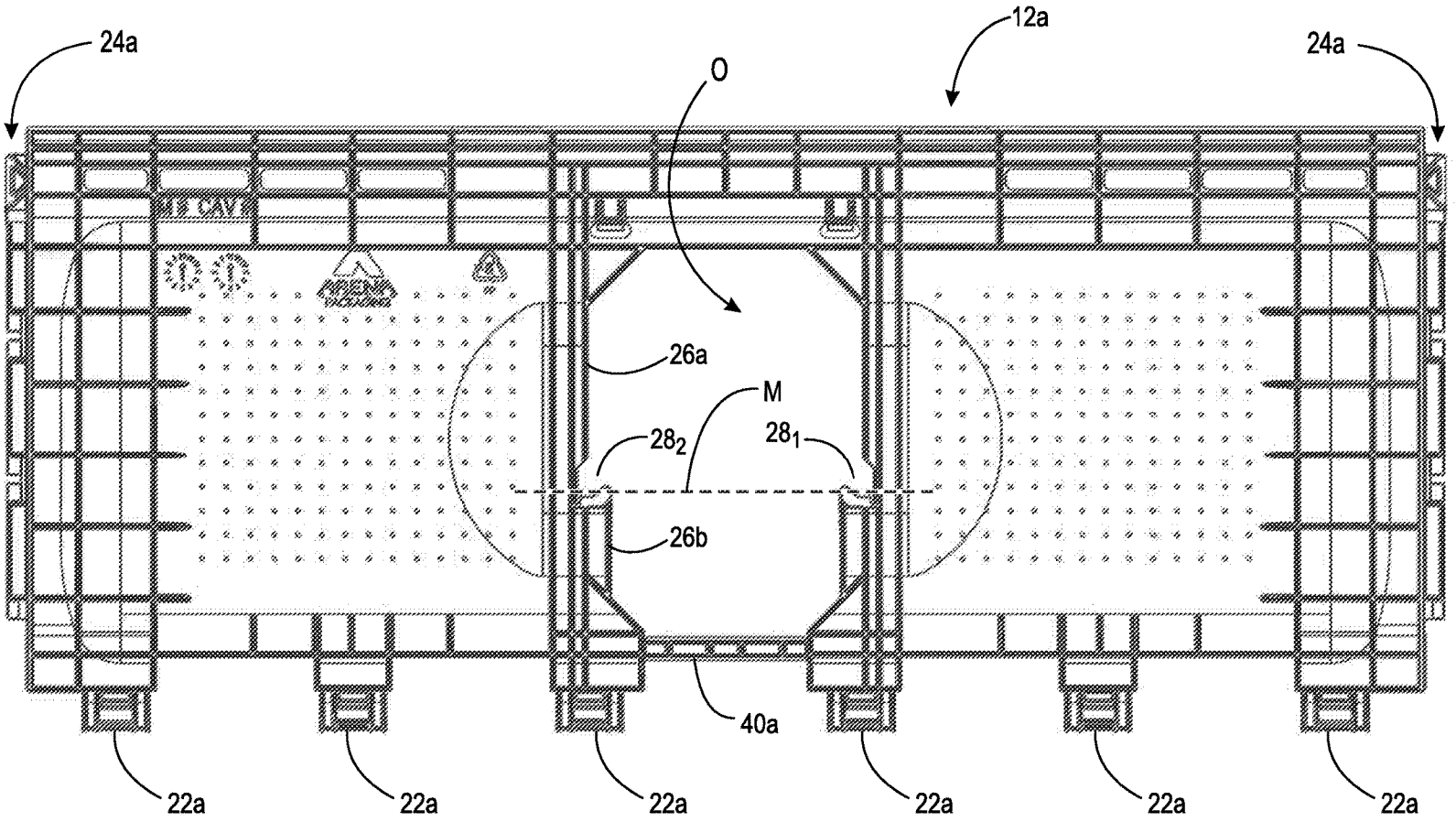
FIGS. 2A and 2B are an exterior, plan view and an interior plan view of a sidewall of the container of FIG. 1A.
Figure 2B:
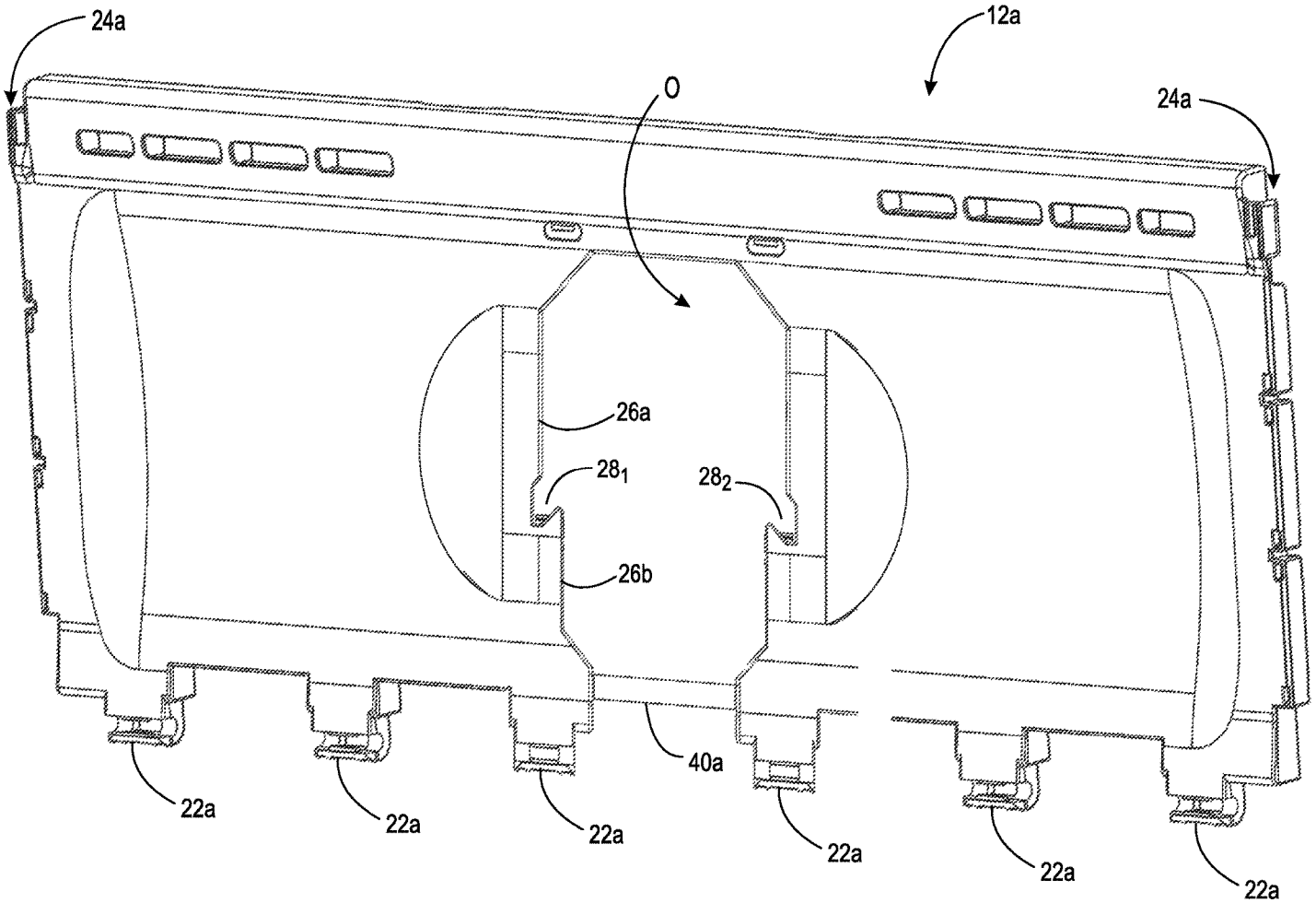

FIGS. 2A and 2B are an exterior, plan view of wall 12*a* and an interior plan view of wall 12*a*, respectively, each shown with the wall separated from the rest of the container. Wall 12*a* includes hinge portions 22*a* and corner latch system portions 24*a*, as well as opening O having catches $\mathbf{28}_1$, $\mathbf{28}_2$ disposed at an intermediate location M along the lateral sides of opening O. In the illustrated embodiment, wall 12*a* includes a first hinge component 40*a* formed as a bar onto which a clamp 40*b* (shown in FIG. 4A) of access door 16 is snapped to form an access door hinge 40.

In some embodiments, as shown, a door jam 26*a* is present around an upper portion of the opening at a location where upper portion 16*a* of access door 16 (shown for example in FIG. 4A) rests against wall 12*a* to help prevent the door from moving into the interior of the container. In some embodiments the door jam 26*a* extends continuously around the upper portion of the opening, however, it may extend over a fraction of the lower portion of the opening or form discontinuous sections around opening O. A door jam 26*b* may also be present around a lower portion of opening O at a location where lower portion 16*b* of access door 16 (shown for example in FIG. 4A) rests to help prevent the door from moving into the interior of the container. In some embodiments, the door jam 26*b* extends continuously around the lower portion of the opening, however, it may extend over a fraction of the lower portion of the opening or form discontinuous sections around the opening. Hinge 40 operates with simple rotation about an axis (e.g., an axis in bar 40*a*), and lower door portion 16*b* does and cannot move radially away from bar 40*a*.

In the illustrated embodiment, catch $\mathbf{28}_1$ and catch $\mathbf{28}_2$ (shown in greater detail in FIGS. 3A-3C) are positioned along a lateral side of opening 0, at wall intermediate location M. As described in greater detail below, the access door includes at least one latch proximate a door intermediate location, the latch to be received in a space defined, at least in part, by catch $\mathbf{28}_1$.

Figure 3A:
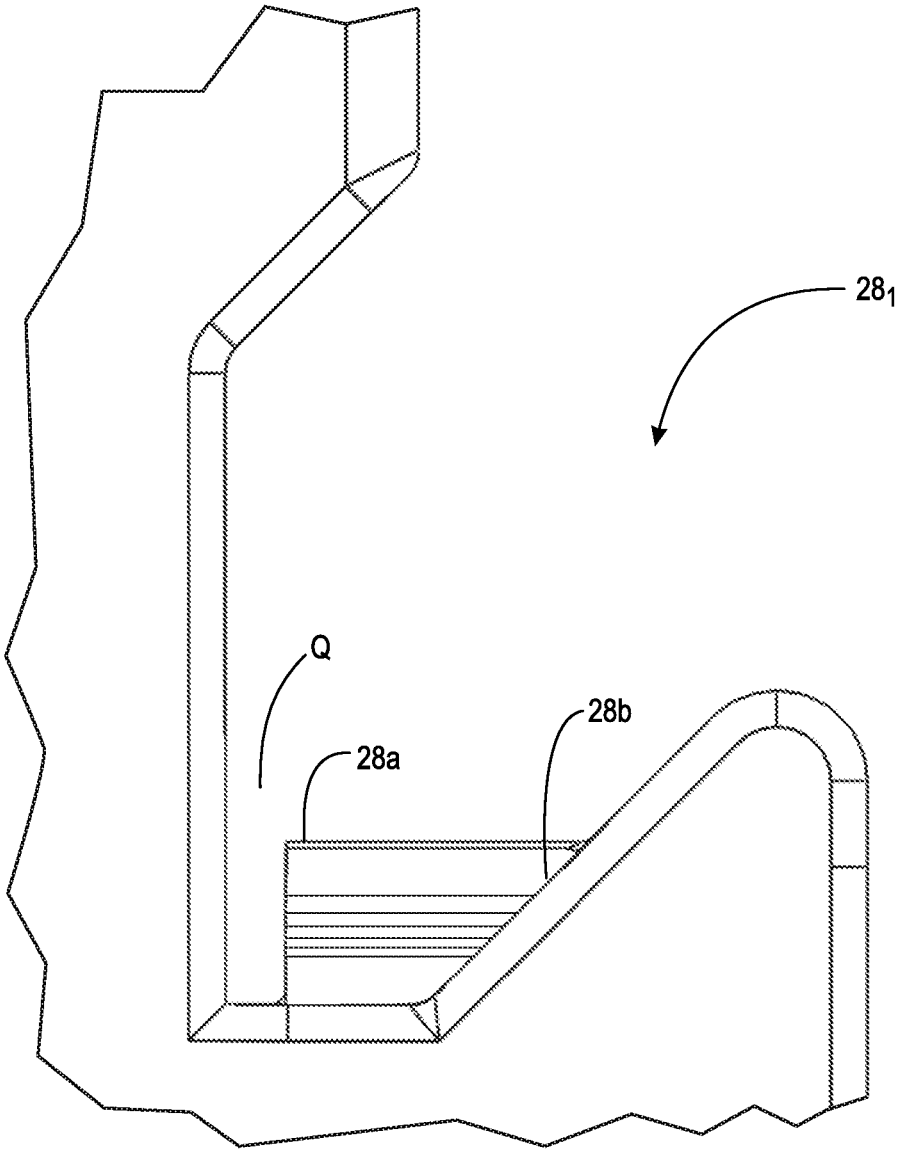
FIGS. 3A-3C are an interior plan view, an exterior plan view and a cross sectional, side view taken at line 3C-3C of FIG. 3B, respectively, showing further detail of a catch of the wall.
Figure 3B:
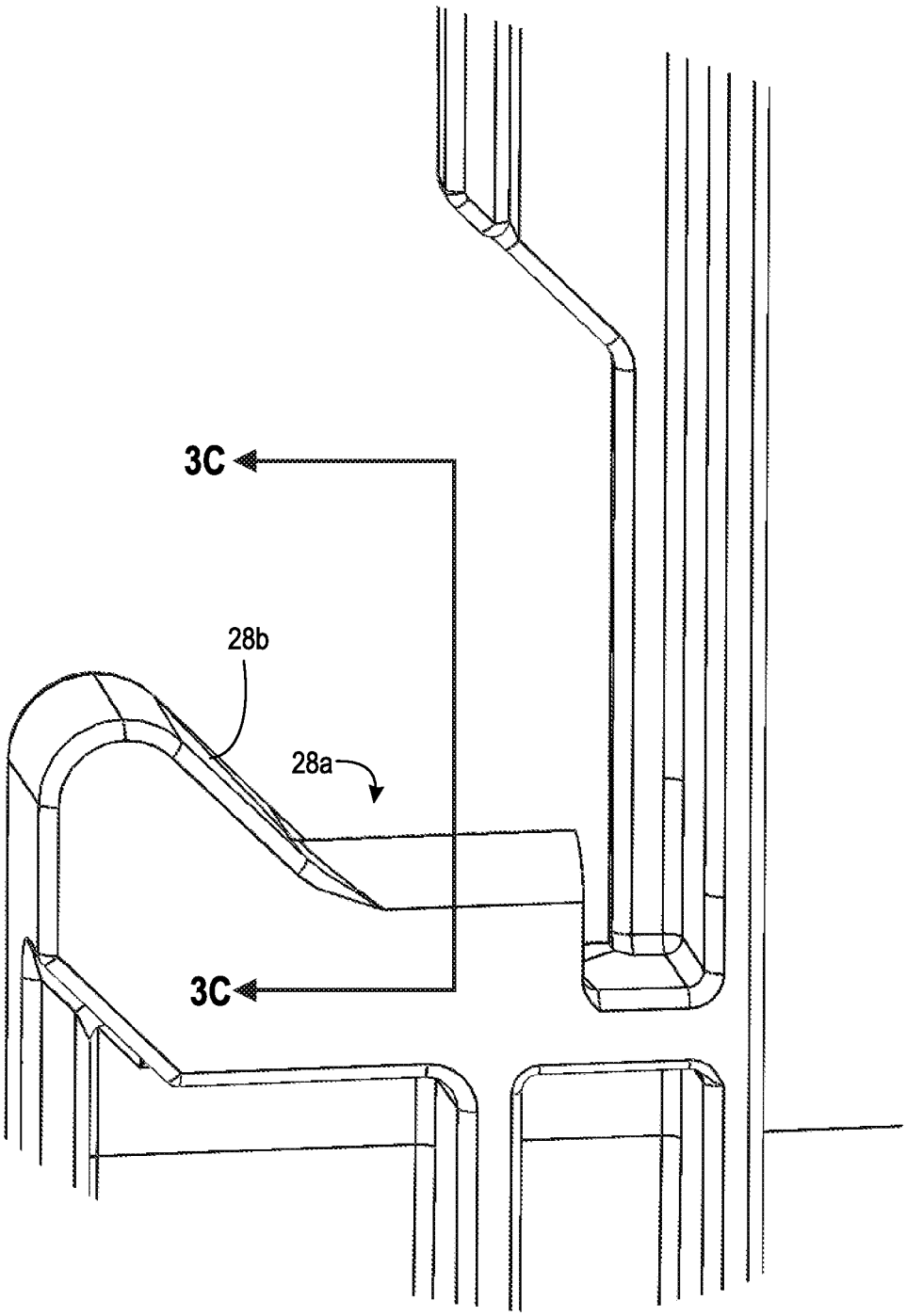
Figure 3C:
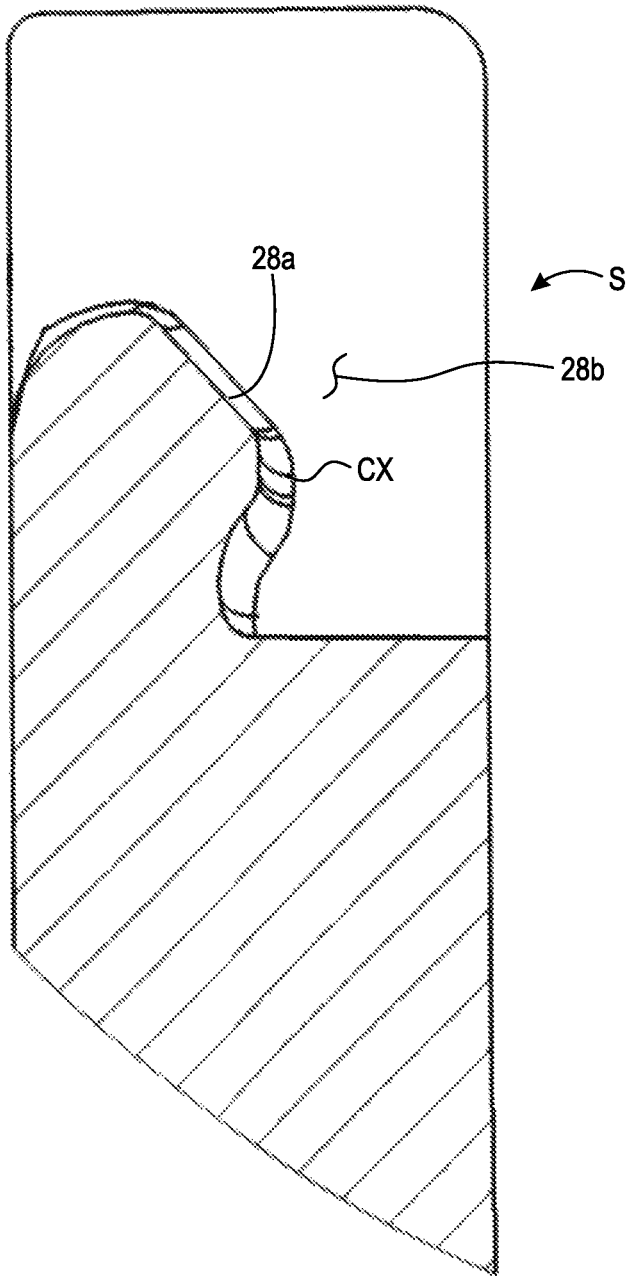

FIGS. 3A-3C are an interior plan view, an exterior plan view and a cross sectional view, respectively, showing catch $\mathbf{28}_1$ in greater detail. Catch $\mathbf{28}_1$ comprises an outer wall 28*a*. Catch $\mathbf{28}_1$ defines, in part, a space S into which latch 45*a* (shown, for example, in FIG. 6A) is received. When access door 16 (shown in FIG. 1A) is in a closed position and the latch is properly located on the inside of outer wall 28*a*, outer wall 28*a* prevents the latch and the intermediate portion of the access door from moving in an outward direction.

One or more additional walls (i.e., in addition to outer wall 28*a*) may be included in a catch to further define space S and limit latch movement in more directions than outward. For example, catch $\mathbf{28}_1$ may further comprises a side wall 28*b* that further defines space S. Additionally, by sloping side wall 28*b*, as illustrated, the inner side wall may help to center access door 16 when the latching is occurring. The position of wall intermediate location M is defined by the uppermost location of an outer wall of the catch, over which a latch moves to enter space S.

Figure 3D:
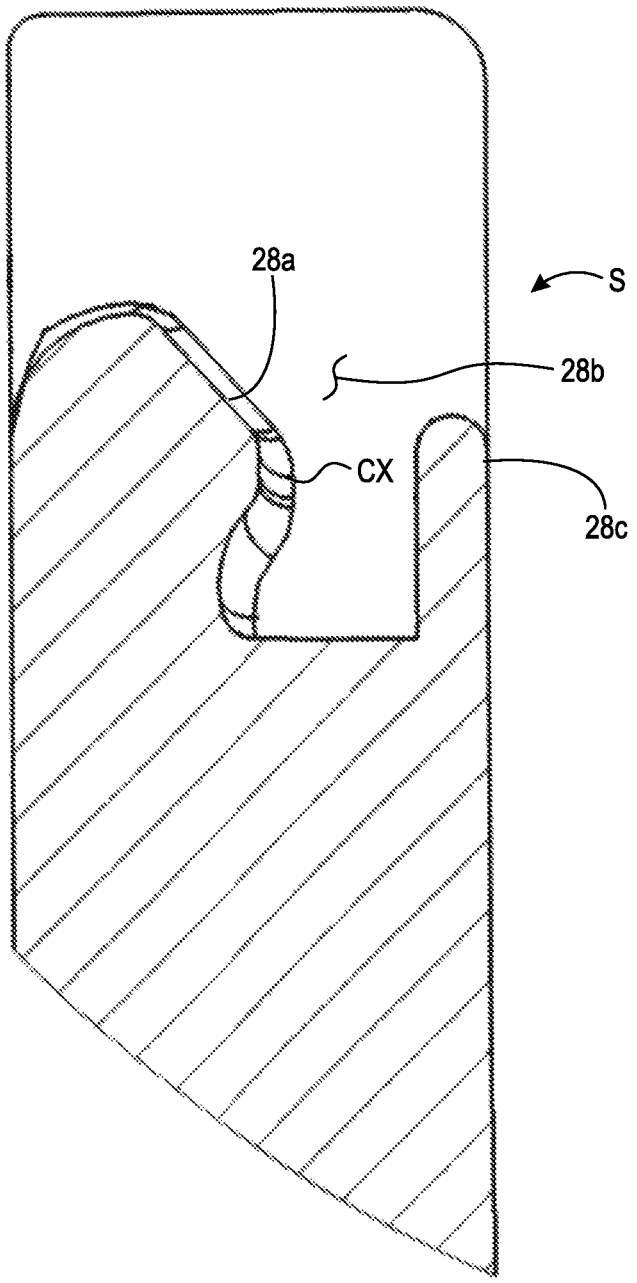
FIG. 3D is a cross sectional view of an alternative embodiment of a catch.

As shown in the embodiment illustrated in FIG. 3D, in some embodiments, an inner wall 28*c* may be present to prevent the latch and the intermediate portion of the wall from moving in an inward direction. In the embodiment illustrated in FIGS. 2A-2B, optional jam interfaces 48*a* and 48*b* (shown in FIG. 4B) in combination with optional jams 26*a* and 26*b* (shown in FIG. 2A) to limit inward and outward movement of access door 16.

Figure 4A:
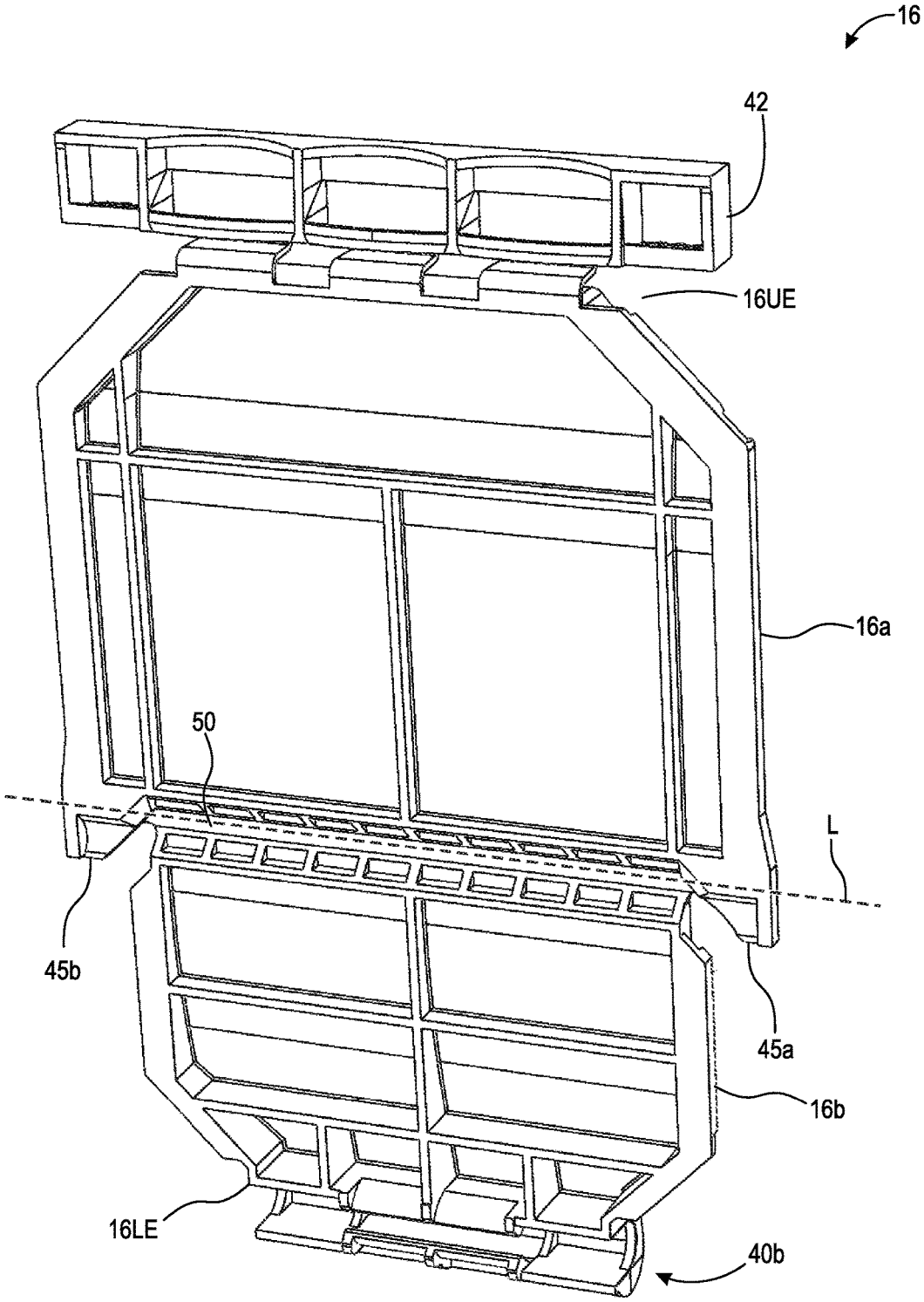
FIGS. 4A and 4B are a projection view of the outside of access door of the container of FIG. 1A, and a plan view of the inside of access door of the container of FIG. 1A, respectively.
Figure 4B:
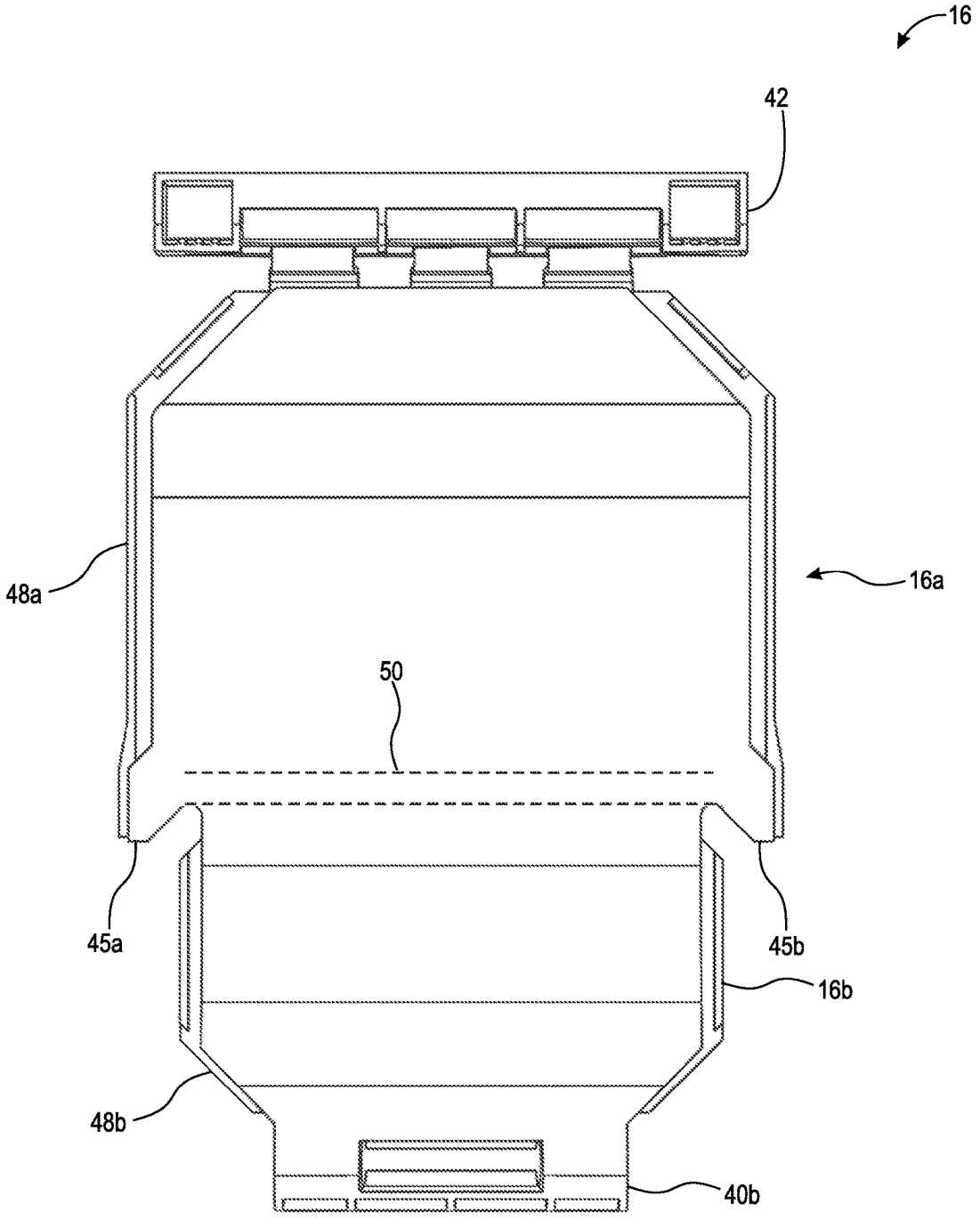

FIG. 4A is a projection view of the outside of access door 16, and FIG. 4B is a plan view of the inside of access door 16. Access door 16 comprises upper portion 16*a* and lower portion 16*b*, a second hinge component 40*b* that couples the bottom of door 16 to wall 12*a* (shown in FIG. 1A), a second hinge 50 which couples upper portion 16*a* to the lower portion 16*b*, and a connector 42 that connects the top of access door 16 to the wall 12*a*, and latches 45*a* and 45*b* for coupling access door 16 to catches $\mathbf{28}_1$ and $\mathbf{28}_1$ of wall 12*a* (shown in FIG. 2A), respectively. It will be appreciated that upper portion 16*a* and lower portion 16*b* are more rigid than the portion of the wall constituting second hinge 50.

As described in greater detail below with reference to FIGS. 5A-5C, access door 16 is movable about a first hinge 40 (which comprises first hinge component 40*a* (shown in FIG. 2A) and second hinge component 40*b*) to an open position. In the illustrated embodiment, the second hinge component 40*b* is formed as a clamp that snaps over corresponding first hinge component 40*a* (e.g., a bar) on wall 12*a*. The clamp rotates about the bar in a conventional manner to achieve the open and closed position. It is to be appreciated that although a particular embodiment of a hinge is illustrated, any suitable rotational bearing may be used. Additionally, although the bar is formed on wall 12*a* it may also be formed on base 13.

Hinge 50 is located at a door intermediate location L. Although the hinge is shown as a living hinge, the hinge may be any suitable rotational bearing configured to allow pivoting movement about intermediate location L. Latches 45*a*, 45*b* extend from the upper portion below door intermediate location L when door 16 is in an unflexed state. Location L is defined as the location of the axis about which the door and latches move when the upper portion 16*a* is rotated relative to lower portion 16*a*, and hinges 22 and 40 are maintained in a given state of rotation. As discussed in greater detail below, door intermediate location L is positioned to be at or above the wall intermediate location M when the container is in an erected arrangement. Upper portion 16*a* has an upper end $\mathbf{16}_{UE}$ where connector 42 is disposed. Connector 42 connects the upper end $\mathbf{16}_{UE}$ to wall 12*a* to maintain access door 16 in the closed position. The lower portion 16*b* has a lower end $\mathbf{16}_{LE}$ where door 16 is coupled to wall 12*a* by second hinge 40.

Connector 42 can be configured as any suitable connector for maintaining door 16 in a closed position. For example, connector 42 can be configured as the latching system described in U.S. Provisional Patent Application 62/387,285, filed Dec. 23, 2015 and titled PRODUCE SHIPPING CONTAINER the entirety of which is hereby incorporated by reference herein.

Location L is disposed intermediate hinge component 40*a* and connector 42. Location L can be located anywhere between hinge component 40*a* and connector 42 (with the catches correspondingly located); however it is typically desirable that location L be located near the midpoint between hinge and connector so that the likelihood that a significant gap between wall 12*a* and door 16 is formed is relatively low. A height of access door 16 is defined as the distance between upper end $\mathbf{16}_{UE}$ and lower end $\mathbf{16}_{LE}$. The term "midpoint" is defined herein to mean in a region that is greater than thirty percent of the access door height from upper end $\mathbf{16}_{UE}$ and greater than thirty percent of the access door height from lower end $\mathbf{16}_{LE}$.

Figure 4C:
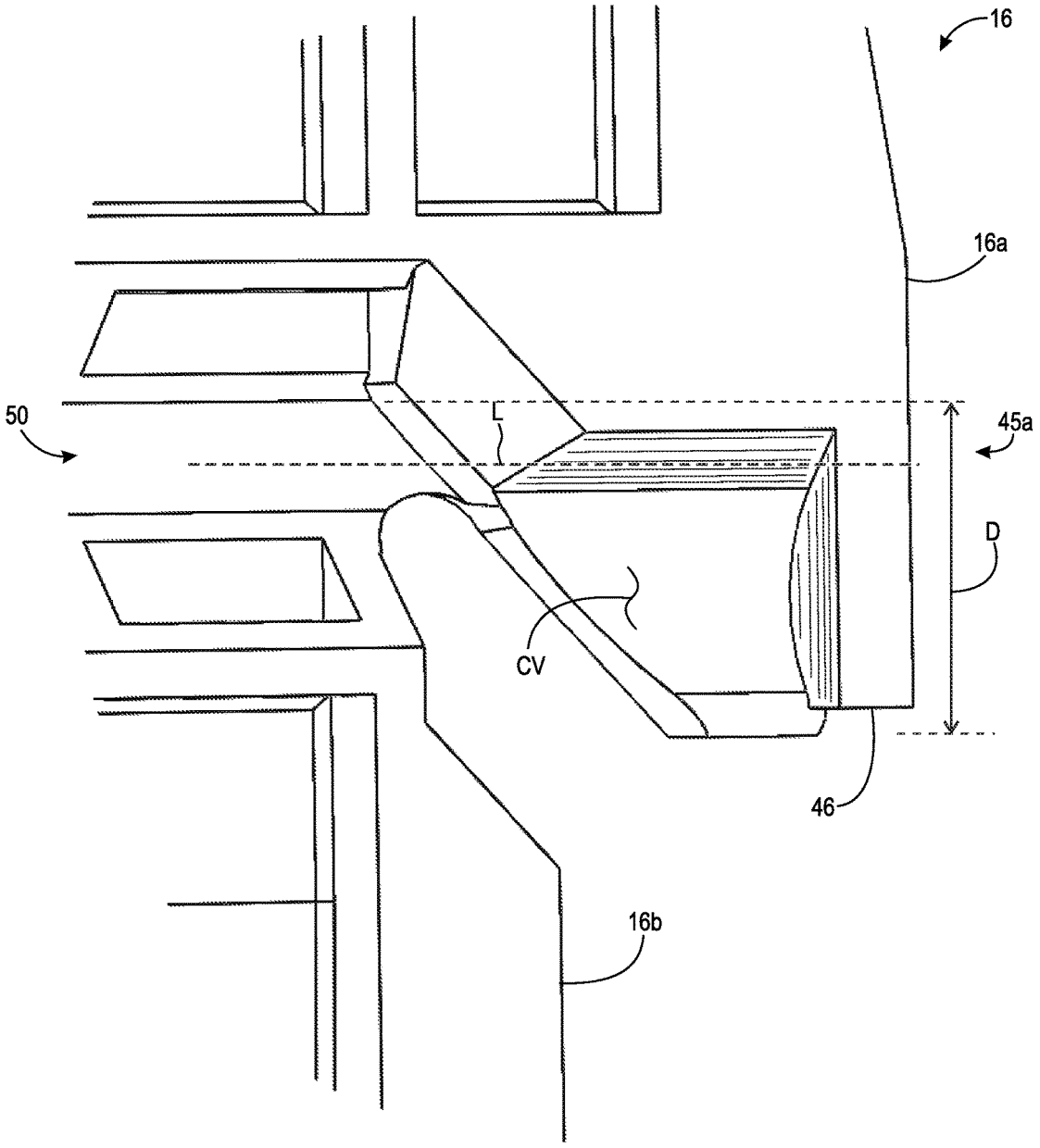
FIGS. 4C and 4D are an exterior view and an interior view of a portion access door of FIG. 1A showing the latch in greater detail.
Figure 4D:
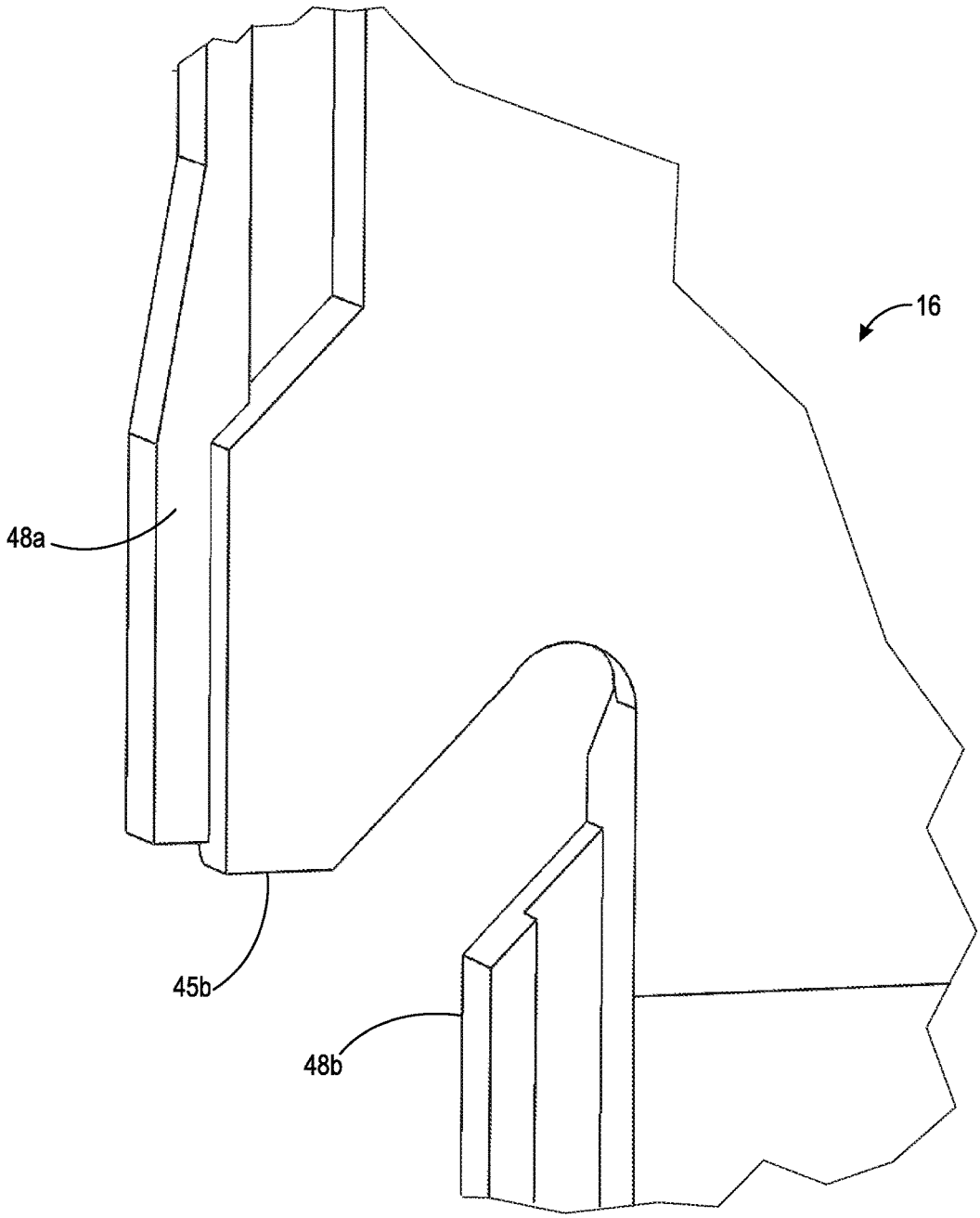

FIGS. 4C and 4D are an exterior view and an interior view, respectively, of a portion of access door 16 showing latch 45*b* in greater detail. Latch 45*b* is a protrusion extending a distance D down form upper portion 16*a* of door 16. As indicated above, latch 45*b* extends for upper portion 16*a* below intermediate location L.

In the illustrated embodiment, the latch includes an outward facing concave surface CV which interfaces with a convex surface CX of catch $\mathbf{28}_1$ (shown in FIG. 3C). Latch also includes an optional raised portion 46 (extending in the outward direction from surface CV) that fits into space Q (shown in FIG. 3A) which provides lateral stability to door 16 when the door is moving to the closed position and when door 16 is in a closed, latched position. As described above, jam interfaces 48*a* and 48*b* may be provided to interface with jam 26*a* and 26*b* (shown in FIG. 2A), respectively. The shape of one embodiment of a latch is illustrated, however, a latch can have any of a variety of shapes. In other embodiments, the latch outward-facing surface may be convex and the catch inward-facing is concave.

Figure 4E:
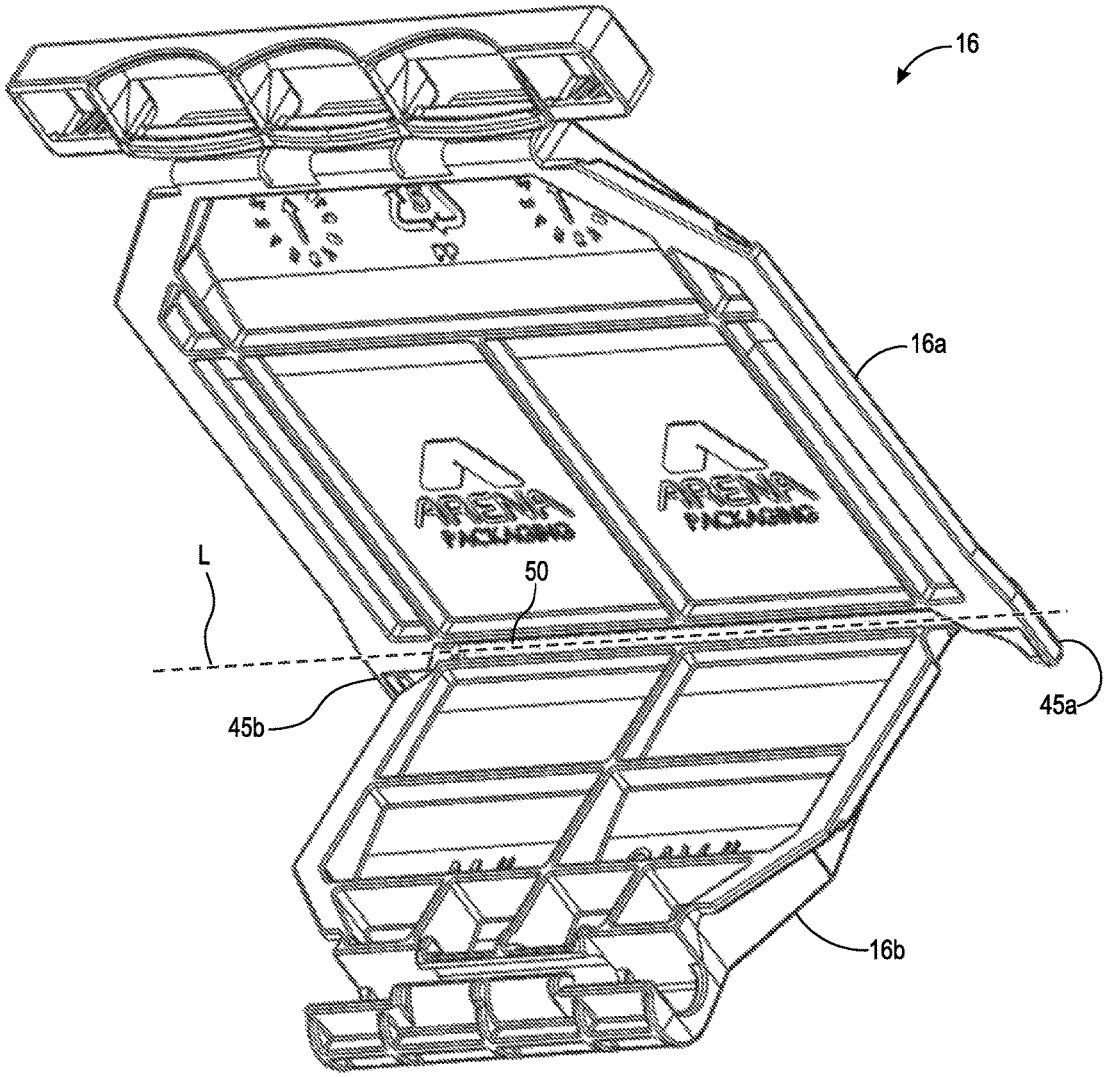
FIGS. 4E and 4F are an exterior view and an interior view of the access door of FIG. 4A when the access door is flexed inwardly at a living hinge located at an intermediate location.
Figure 4F:
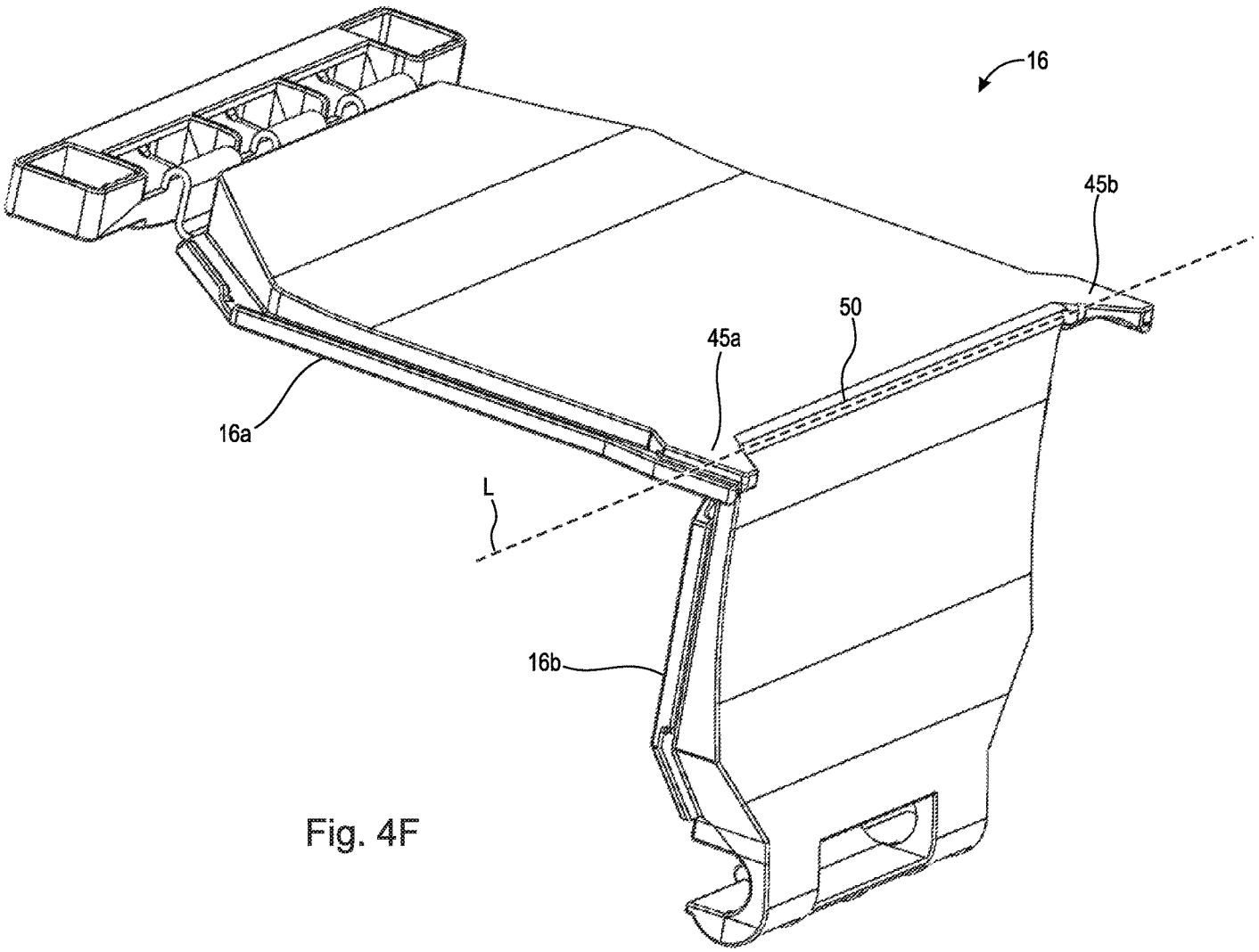
Figure 4G:
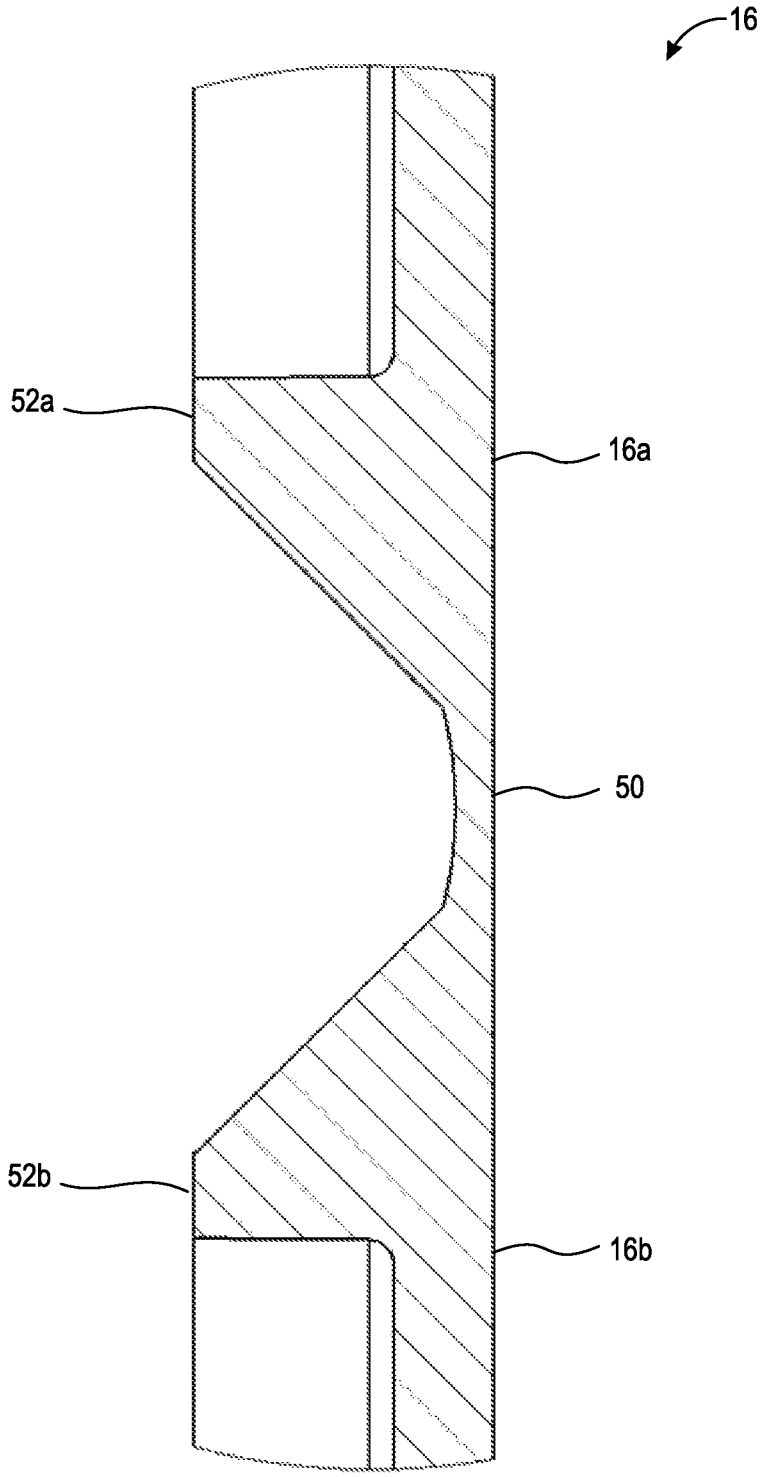
FIG. 4G is a cross sectional view of a portion of the access door of FIG. 4A showing further details of the construction of the living hinge.

FIGS. 4E and 4F are an exterior view and an interior view of access door 16 when it is flexed inwardly about second hinge 50 at intermediate location L. FIG. 4G is a cross sectional view of a portion of access door 16 showing further detail of the construction of living hinge 50. FIG. 4G shows the narrowed portion of access door 16 that constitutes the hinge. The narrowed portion permits relative rotation of upper portion 16*a* and lower portion 16*b* about intermediate location L. Hinge 50 is constructed and operates in a convention manner. Ribs 52*a* and 52*b* are included above and below hinge 50, respectively, to localize the flexure of the hinge.

Figure 5A:
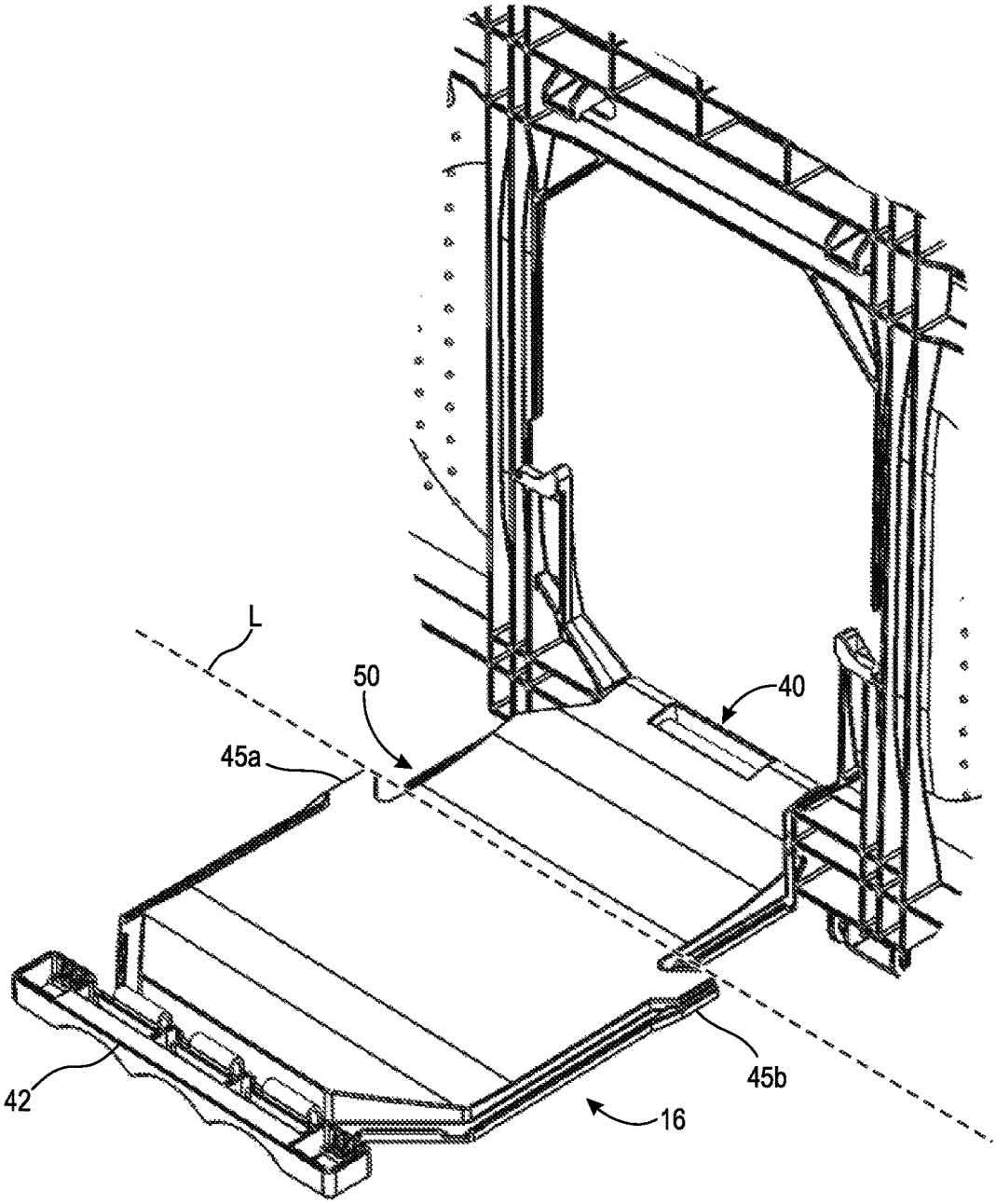
FIGS. 5A, 5B and 5C show the access door in an open state, a partially closed state with the hinge flexed, and closed state, respectively.
Figure 5B:
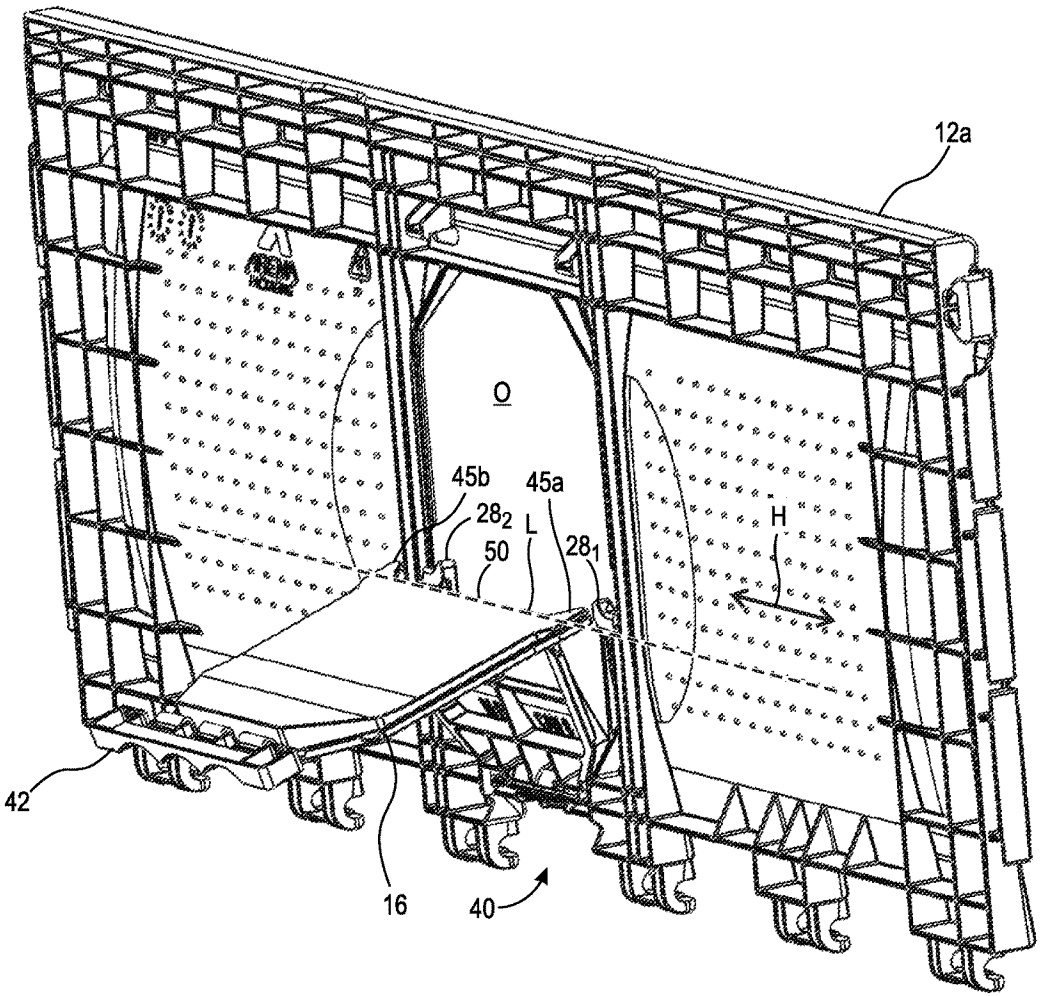
Figure 5C:
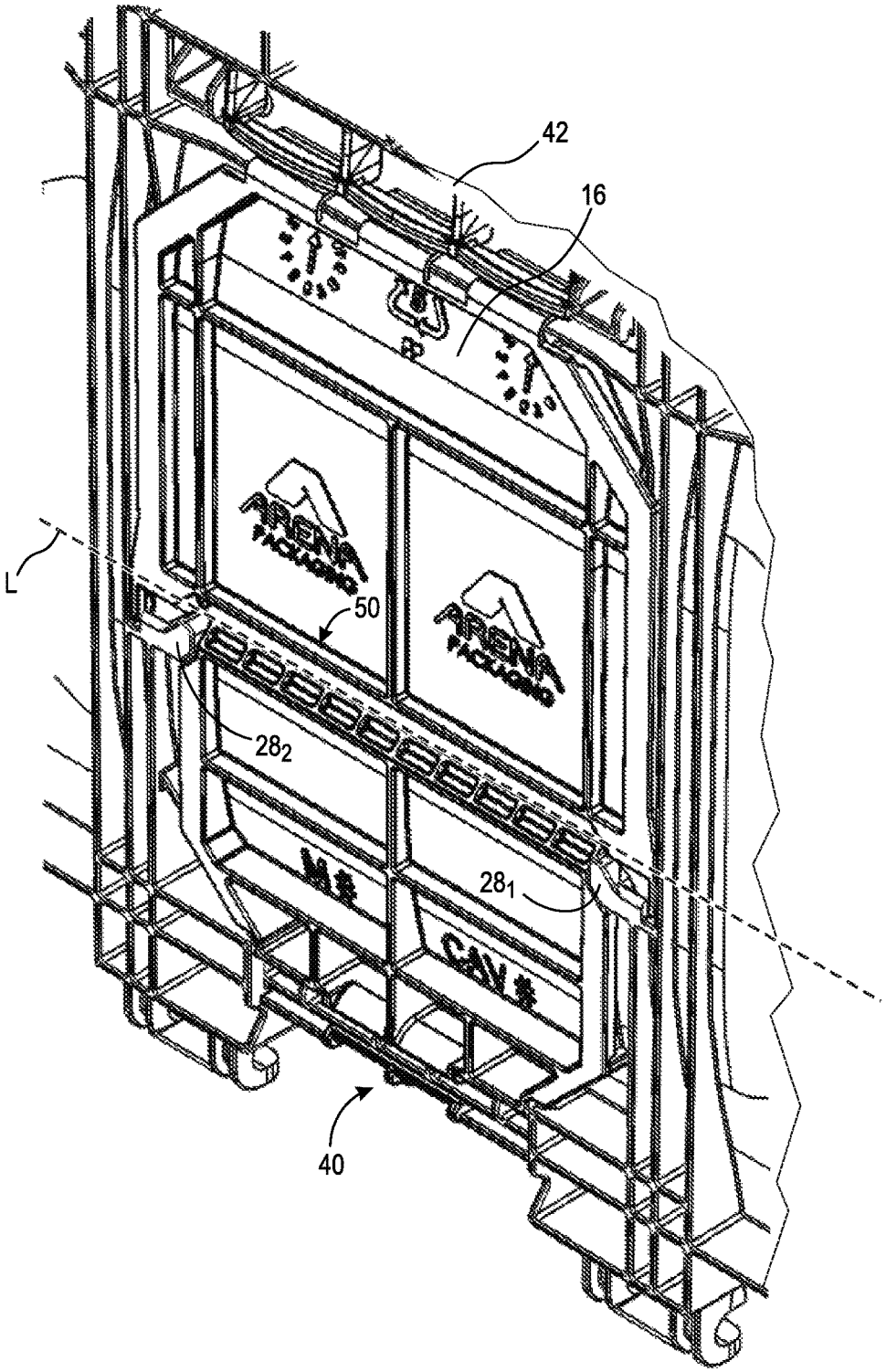

FIGS. 5A, 5B and 5C show door 16 in the open position, the partially closed position with the hinge flexed, and the closed position, respectively. In both FIGS. 5A and 5C, door 16 is unflexed about the intermediate location L. In FIG. 5B, door 16 is flexed to allow latches 45*a* and 45*b* to be moved to a location above catches $\mathbf{28}_1$ and $\mathbf{28}_2$ (also shown in FIGS. 6A and 6B for latch 45*a* and catch $\mathbf{28}_1$). Access door 16 is movable about second hinge 50 from a closed position, in which the door covers opening O, to an open position in which the interior of the container can be accessed through the opening.

Door intermediate location L is positioned to be at or above the wall intermediate location M when the container is in an erected arrangement. As shown in greater detail below in FIGS. 6A and 6B, as door 16 is rotated about hinge 40 toward a closed state, such a configuration allows a flexed state (of hinge 50) to be attained, where latches 45*a* and 45*b* are moved to a location above catches 28*a* and 28*b* such that door 16 can be rotated about first hinge 40 (shown in FIGS. 5A-5C) to a closed position. It will be appreciated that latches 45*a* and 4*b* are aligned with catches $\mathbf{28}_1$ and $\mathbf{28}_2$, respectively, in the horizontal direction H so that each latch is received into a space S when door 16 is moved to the closed position. When door 16 is in the closed position, connector 42 can connect access door 16 to wall 12*a* to maintain door 16 in a closed position.

Figure 6A:
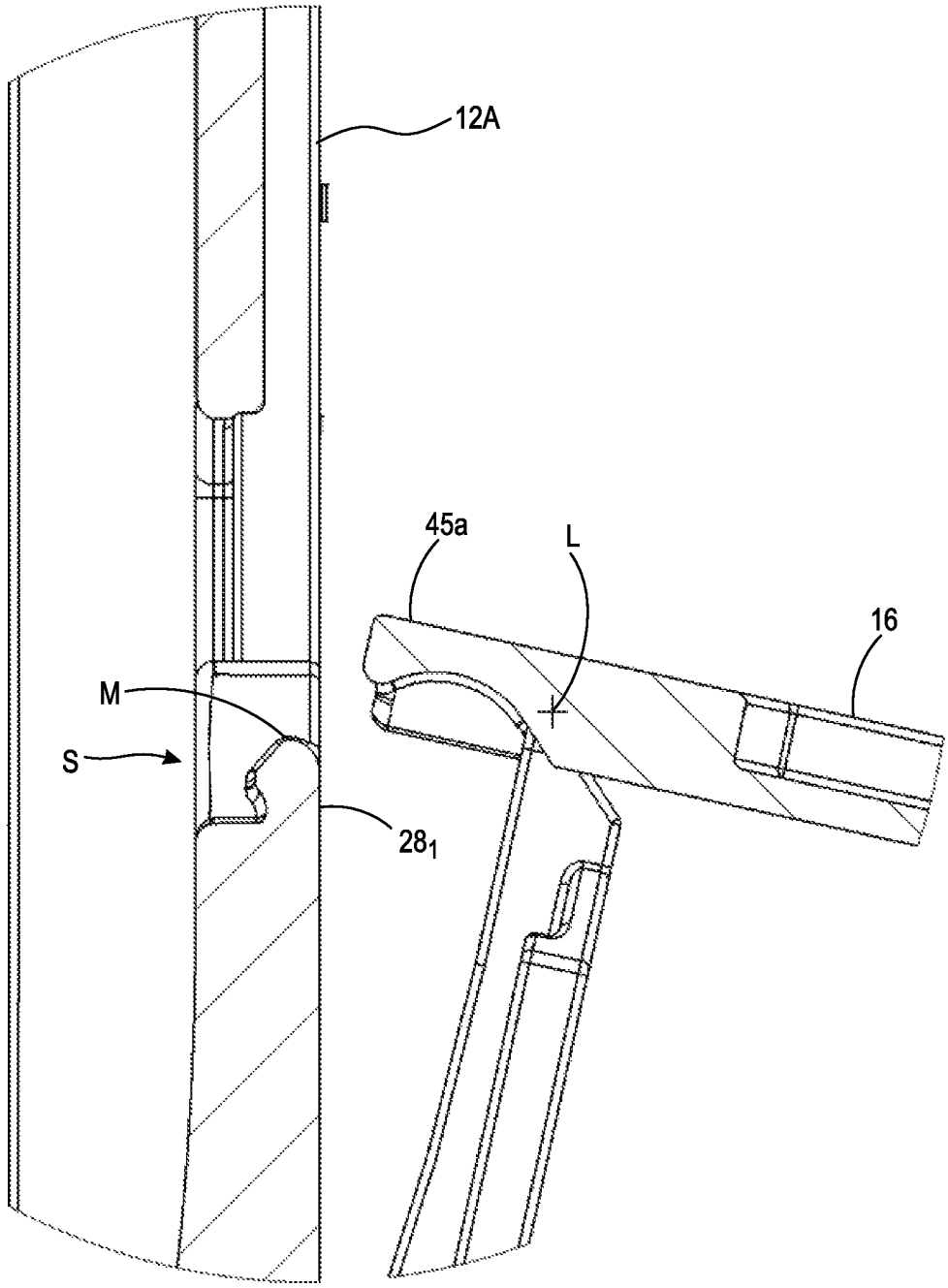
FIGS. 6A-6D are cross sections of the access door and the wall of FIG. 5A-5C showing the latching process in greater detail.
Figure 6B:
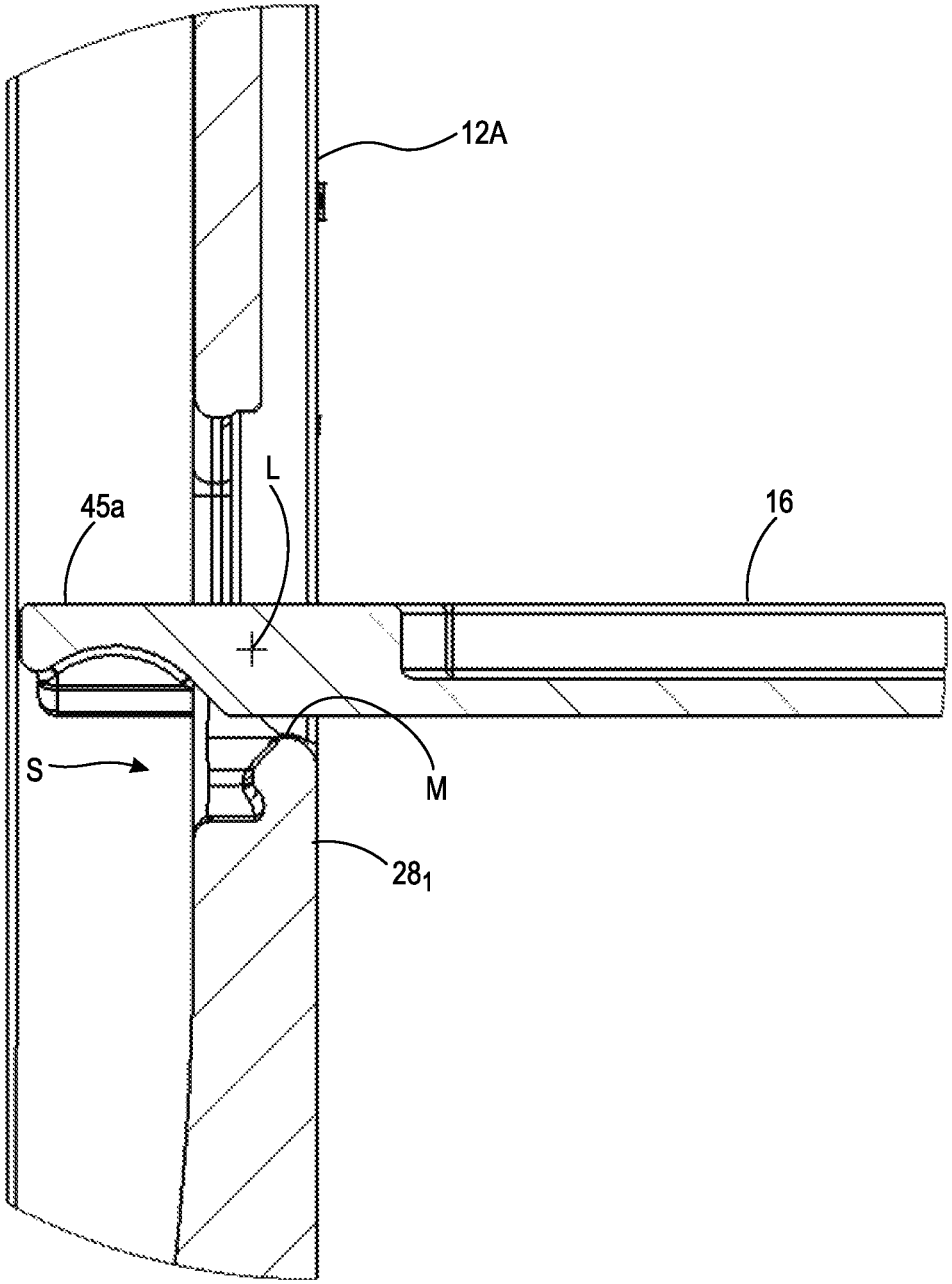
Figure 6C:
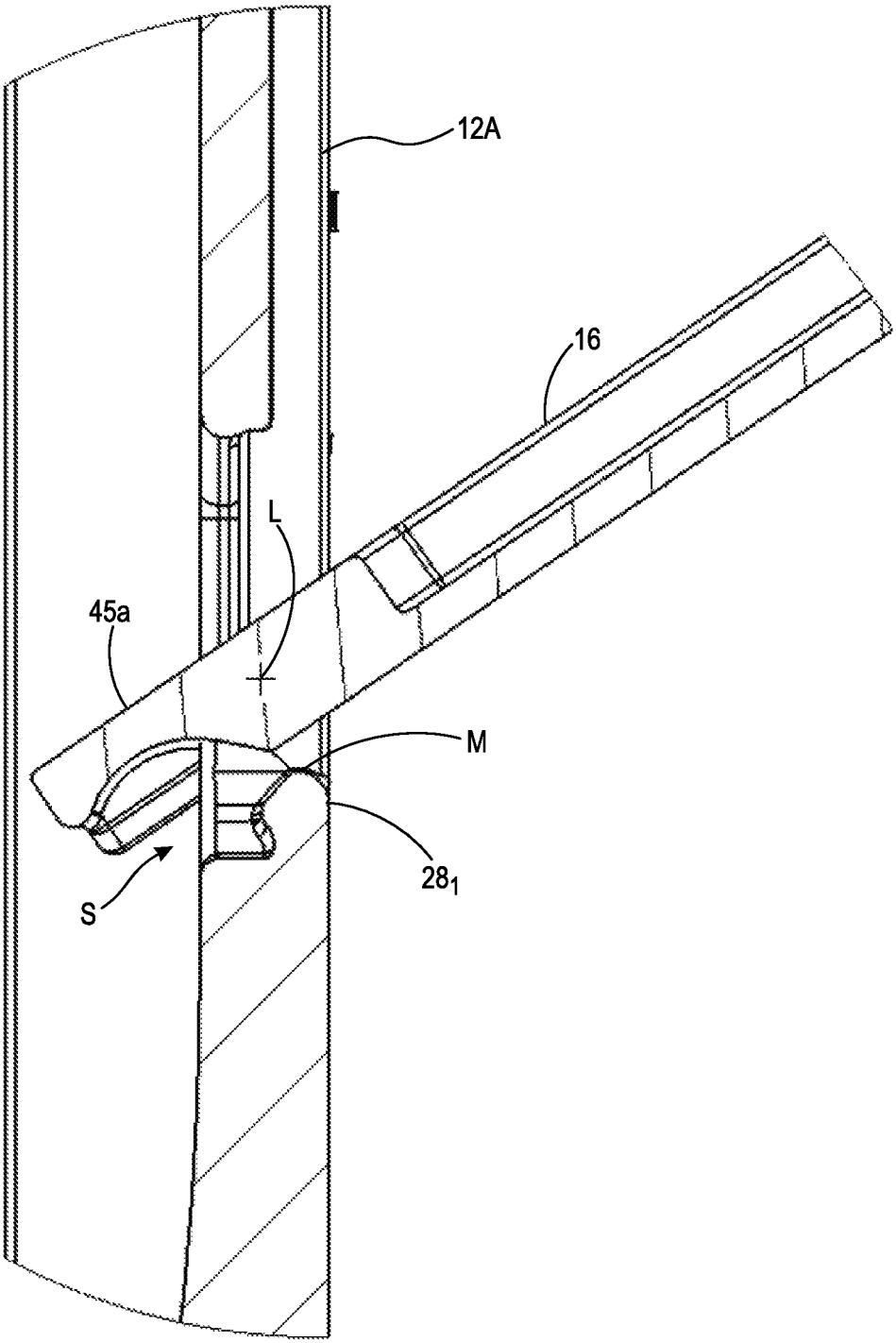
Figure 6D:
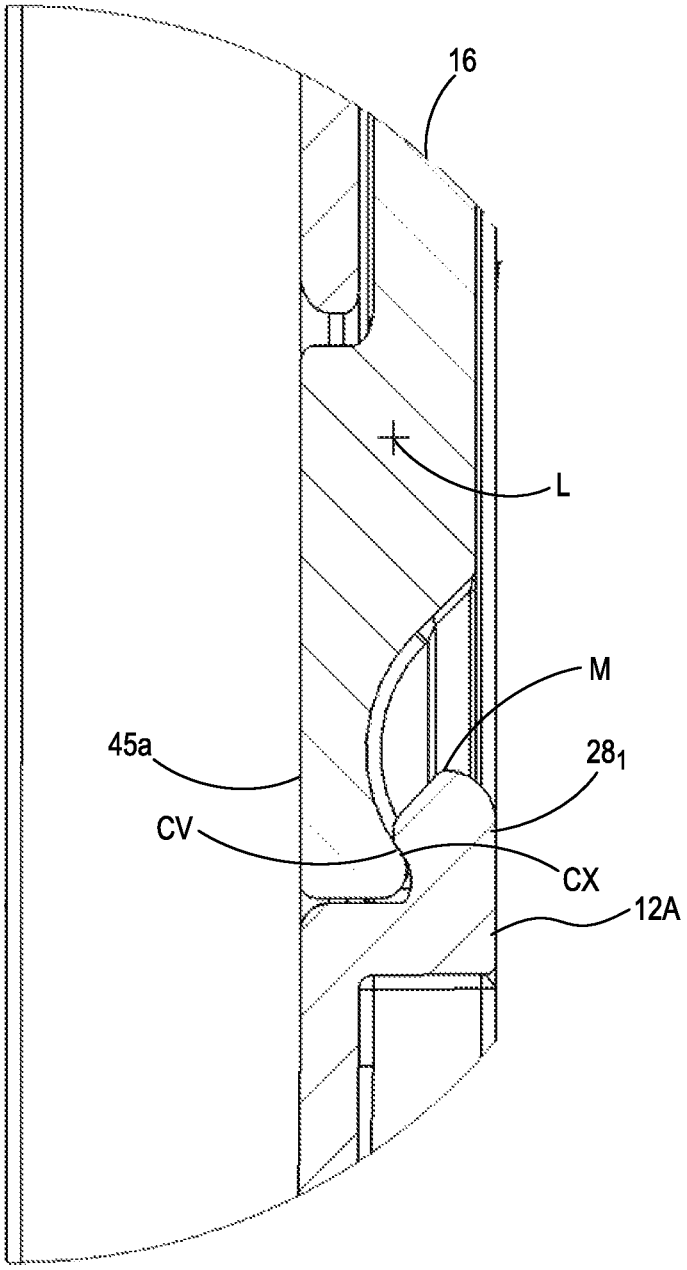

FIGS. 6A-6D are cross-sectional views of access door 16 and wall 12*a* showing the latching process of latching system 20 in greater detail. FIG. 6A shows access door 16 flexed about the intermediate location L such that latch 45*a* is raised above catch $\mathbf{28}_1$, as access door 16 is rotated toward a closed position. FIG. 6B shows door 16 rotated to a position where latch 45*a* has cleared catch $\mathbf{28}_1$ and access door 16 remains flexed about the intermediate location L. FIG. 6C shows access door 16 as the door begins to be rotated about intermediate location L toward the unflexed state. FIG. 6D shows door 16 in the unflexed state with latch 45*a* exterior-facing surface CV interfacing with interior surface CX of catch $\mathbf{28}_1$. When in the state illustrated in FIG. 6D, door 16 is in the closed state and latch 45*a* is moved to its final position. Connector 42 (shown in FIG. 5C) may actuated to connect access door 16 to wall 12*a*. Actuation of the connector may occur as a result of the access door rotating around intermediate location L to the unflexed state or additional action may be taken to connect access door 16 to wall 12*a*. It is to be appreciated that, for the illustrated embodiment, all of steps 5A-6D are achieved with movement at hinge 40 that involves only rotation of lower door portion 16*b* (i.e., in the illustrated embodiment, lower door portion 16*b* is not and cannot be moved radially away from bar 40*a*).

Modifications and changes to aspects of the invention described above should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A container having an interior to hold produce, comprising:

A) a base;

B) four walls, which in combination with the base define the interior, each of the walls being coupled to the base, at least one of the walls having an opening allowing access to the interior, the one of the walls having a first catch positioned at a wall intermediate location along a first lateral side of the opening;

C) a door i) the door having a rigid upper portion and a rigid lower portion coupled to the upper portion by a first hinge at a door intermediate location, the door intermediate location being positioned at or above the wall intermediate location when the container is in an erected arrangement, the upper portion having an upper end and the lower portion having a lower end, ii) the door being coupled to the one of the walls by a hinge at the lower end, the door movable about the hinge at the lower end of the door from a closed position in which the door covers the opening to an open position in which the interior can be accessed through the opening, iii) the door having a first rigid latch extending from the upper portion to a location below the door intermediate location when the door is in an unflexed state and the first rigid latch aligned with the first catch so as to be received in a space defined by the first catch with an interior surface of the first catch facing an exterior-facing surface of the first latch when the door is moved to the closed position, and iv) the door having a connector to connect the upper end to the one of the walls to maintain the closed position.

2. The container of claim 1, wherein a second catch is disposed along a second lateral side of the opening that is opposite the first lateral side on which the first latch is disposed, and a second rigid latch extending from the upper portion to a location below the door intermediate location when the door is in the unflexed state and the second latch aligned with the second catch so as to be received in a second space defined by the second catch with an interior surface of the second catch facing an exterior-facing surface of the second latch when the door is moved to the closed position.

3. The container of claim 1, wherein the door intermediate location is disposed at a midpoint of the door.

4. The container of claim 1, wherein the four walls comprise two opposing sidewalls and two opposing end-walls.

5. The container of claim 4, wherein the opening is disposed in a sidewall.

6. The container of claim 1, wherein each of the walls is attached to the base by a corresponding at least one rotatable bearing.

7. The container of claim 1, wherein the at least one of the walls comprises a jam extending around at least a portion of the opening, and the door rests against the jam when the door is in the closed position.

8. The container of claim 1, wherein the interior-facing surface is disposed on an outer wall of the first catch, the outer wall defining the space into which the first latch is received, and the first catch further comprises at least one of a side wall and an inner wall to further define the space.

9. The container of claim 1, wherein the interior surface of the first catch has one of a convex shape and a concave shape, and the exterior-facing surface of the first latch has the other of the convex shape and the concave shape, the exterior-facing surface of the first latch being interfaced with the interior surface of the first catch.

10. The container of claim 1, wherein the first hinge is a living hinge.

* * * * *